US011638506B2

(12) United States Patent
Hong et al.

(10) Patent No.: US 11,638,506 B2
(45) Date of Patent: May 2, 2023

(54) ROBOT CLEANER

(71) Applicant: LG ELECTRONICS INC., Seoul (KR)

(72) Inventors: Woo Hong, Seoul (KR); Sangik Lee, Seoul (KR); Jongho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 252 days.

(21) Appl. No.: 17/106,043

(22) Filed: Nov. 27, 2020

(65) Prior Publication Data

US 2021/0161339 A1 Jun. 3, 2021

(30) Foreign Application Priority Data

Nov. 29, 2019 (KR) ..... 10-2019-0157435
Nov. 29, 2019 (KR) ..... 10-2019-0157437

(51) Int. Cl.
*A47L 9/04* (2006.01)
*A47L 9/28* (2006.01)

(52) U.S. Cl.
CPC ..... *A47L 9/0455* (2013.01); *A47L 9/0477* (2013.01); *A47L 9/0494* (2013.01); *A47L 9/2852* (2013.01); *A47L 2201/04* (2013.01)

(58) Field of Classification Search
CPC .... A47L 9/0455; A47L 9/0477; A47L 9/0494; A47L 9/2852; A47L 2201/04; A47L 9/009
See application file for complete search history.

(56) References Cited

U.S. PATENT DOCUMENTS

2005/0076466 A1 4/2005 Yan
2018/0360281 A1 12/2018 Shin et al.

FOREIGN PATENT DOCUMENTS

| | | | | |
|---|---|---|---|---|
| CN | 106793903 | | 5/2017 | |
| CN | 107920703 | | 4/2018 | |
| EP | 0803224 | A2 * | 10/1997 | ..... A47L 9/0494 |
| JP | 06-248621 | | 9/1994 | |
| KR | 10-2006-0038797 | | 5/2006 | |
| KR | 10-1055910 | | 8/2011 | |
| KR | 10-2014-0096599 | | 8/2014 | |
| KR | 10-2017-0099627 | | 9/2017 | |

OTHER PUBLICATIONS

International Search Report dated Feb. 2, 2021 issued in Application No. PCT/KR2020/015186.
Chinese Office Action dated Feb. 3, 2023 issued in Application No. 202080081404.1.

* cited by examiner

*Primary Examiner* — David Redding
(74) *Attorney, Agent, or Firm* — Ked & Associates, LLP

(57) ABSTRACT

A robot cleaner includes a main body that autonomously travels, a suction nozzle configured to move up and down or swing with respect to the main body, and a support to support the suction nozzle. The robot cleaner may respond to a change in a height of a floor to improve travel performance and may respond better to obstacles. Even when a height difference of the floor is large, cleaning performance may be improved by maintaining contact and increasing a suction pressure of the suction nozzle.

21 Claims, 25 Drawing Sheets

ROBOT CLEANER

CROSS-REFERENCE TO RELATED APPLICATIONS

Pursuant to 35 U.S.C. § 119(a), this application claims the benefit of the earlier filing date and the right of priority to Korean Patent Applications No. 10-2019-0157435, filed in Korea on Nov. 29, 2019, and No. 10-2019-0157437, filed in Korea on Nov. 29, 2019, the contents of which are incorporated by reference herein in their entirety.

BACKGROUND

1. Field

The present disclosure relates to a robot cleaner.

2. Background

A robot cleaner is a device that sucks foreign substances such as dust from a floor while traveling autonomously in a floor (e.g., a floor or ground surface of a room). A robot cleaner may include a suction nozzle module brought into contact with the floor to suck foreign substances (e.g., dust) on the surface together with air.

When a robot cleaner travels when a suction nozzle is fixed to the robot cleaner, a height of a floor may be changed according to various types of floor environments or types. For example, while a robot cleaner is traveling, various types of travel environments exist, such as floor plates, floorings, door frames, tiles, rugs, and carpets.

However, the related art robot cleaner as a suction nozzle contacts the floor, and the suction nozzle may be caught on the flooring due to a changing or inconsistent height of the floor. For example, depending on a degree of softness of a carpet, driving wheels of the robot cleaner may sink below a surface of the carpet, and the suction nozzle may be caught by the carpet, which may impede travel on the floor. A friction force between the driving wheels and the floor may decrease, causing slippage of the driving wheels and increase of a driving load of the wheels, thereby reducing a traveling time of the robot cleaner and reducing a quality. In addition, due to an increase in a load of a rotation brush, a rotating speed of the brush may be decreased, and cleaning performance may be deteriorated.

KR 10-2017-0099627 A (published on Sep. 1, 2017) discloses a suction structure of a robot cleaner that moves up or down according to a surface condition of a floor in order to reduce a suction nozzle from catching. The robot cleaner includes a first supporting portion and a second supporting portion protruding from one side of a suction portion and spaced apart in a lengthwise direction. Ends of the first supporting portion and the second supporting portion form a rotation shaft according to an upward movement or a downward movement of the suction portion. As the suction portion rotates to be movable up and down about the rotation shaft formed at the ends of the first supporting portion and the second supporting portion, the suction portion may move up or down according to a condition of a floor surface.

However, the robot cleaner needs to implement a climbing angle variable operation that helps to climb an obstacle in addition to an up-down movement of the suction nozzle.

The above references is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, wherein.

DETAILED DESCRIPTION

Figure 1:
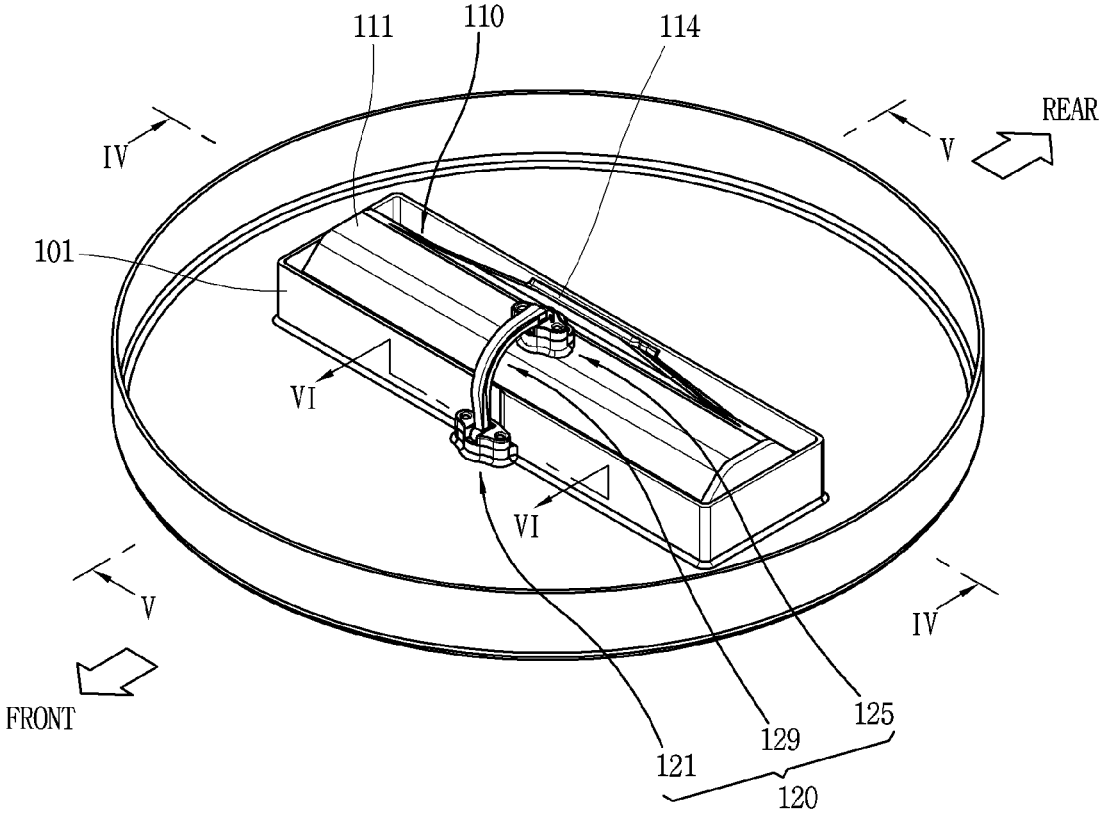
FIG. 1 is a conceptual view illustrating a state in which a suction nozzle according to the present disclosure is mounted on a cleaner main body of a robot cleaner.
Figure 2:
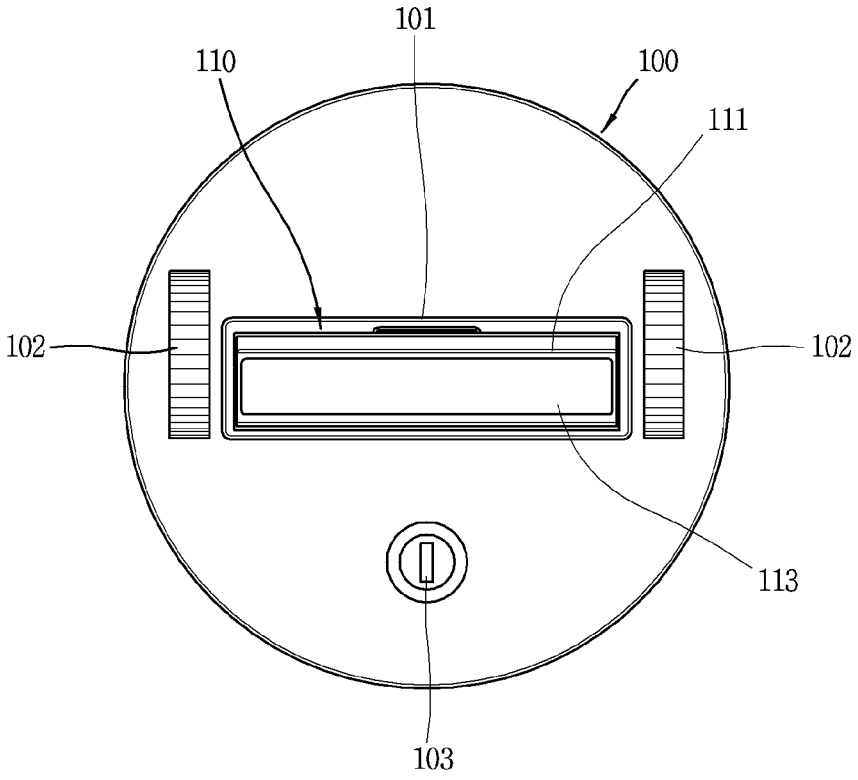
FIG. 2 is a bottom view illustrating a bottom surface of the cleaner main body of FIG. 1.

Referring to FIGS. 1-2, the robot cleaner may include a cleaner main body or case 100, a wheel unit or assembly, and a suction nozzle 110.

The cleaner main body 100 may define an outer appearance or provide an exterior surface of the robot cleaner. The cleaner main body 100 may be formed in a flat cylindrical or disc shape whose height is relatively small compared to its diameter.

The wheel unit may include a plurality of driving or primary wheels 102 and an auxiliary wheel 103. The plurality of driving wheels 102 may be rotatably mounted on the cleaner main body 100 to move the robot cleaner. The plurality of driving wheels 102 may be configured to allow the robot cleaner to travel autonomously. The plurality of driving wheels 102 may be provided at a left side and a right side of the cleaner main body 100, respectively.

Each of the plurality of wheels 102 may be connected to a wheel driving motor. The wheel driving motor may be configured to independently drive each of the plurality of driving wheels 102. As a rotation speed of the wheel driving motor is controlled, the driving wheel 102 on the left side and the driving wheel 102 on the right side may be rotated at different speeds to control a direction. As each of the driving wheels 102 is independently operated, steering such as left and right turning and forward and backward movements of the robot cleaner may be performed.

The auxiliary wheel 103 may be rotatably installed at a front side or a rear side of the cleaner main body 100. The auxiliary wheel 103 may assist the driving wheels 102 to facilitate steering of the cleaner main body 100.

An accommodating portion or protrusion 101 may protrude upward (in FIG. 3) from a lower surface of the cleaner main body 100. Alternatively, the accommodating portion 101 may be a recess recessed in a lower surface of the cleaner main body 100. The accommodating portion or protrusion 101 may be formed in a rectangular box shape having a long length in a left-right direction of the cleaner main body 100. The accommodating portion 101 may also be referred to as wall, a nozzle or agitator housing, or case.

A communication hole or space may be formed in the accommodating portion 101. The communication hole may penetrate the cleaner main body 100 in a vertical direction at a position within the accommodating portion to communicate with a floor on a traveling path of the robot cleaner. The communication hole or space may also be referred to as a suction port of the main body. The suction port 112 (FIG. 7A) of the suction body 111 may communicate with the communication hole or space of the accommodating portion 101, as the suction body 111 may be provided in the accommodating portion 101. The suction nozzle 110 may be provided in the accommodating portion 101 and mounted on the cleaner main body 100.

Figure 3:
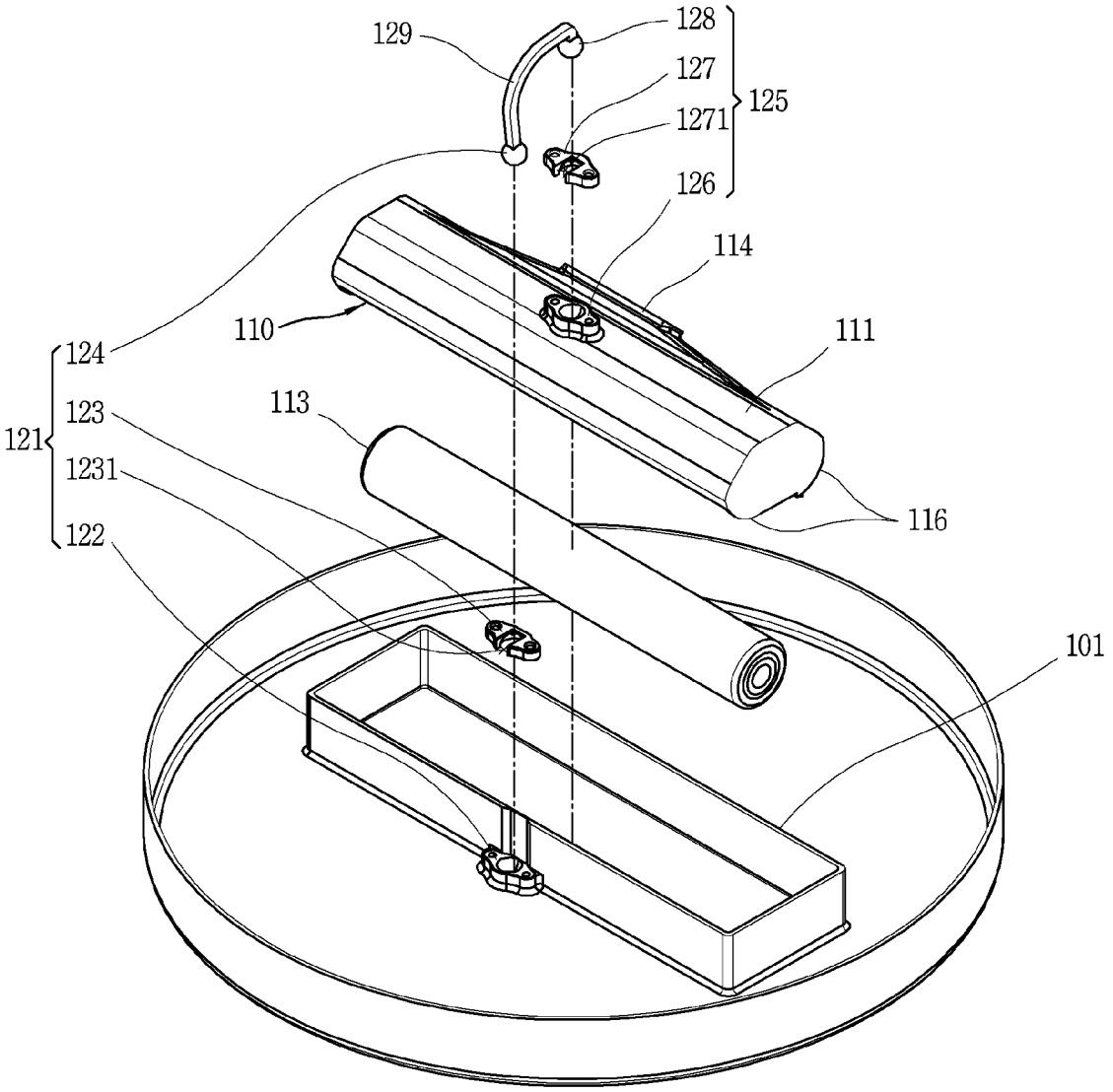
FIG. 3 is an exploded view illustrating a state in which the suction nozzle is disassembled from the cleaner main body of FIG. 1.
Figure 4:
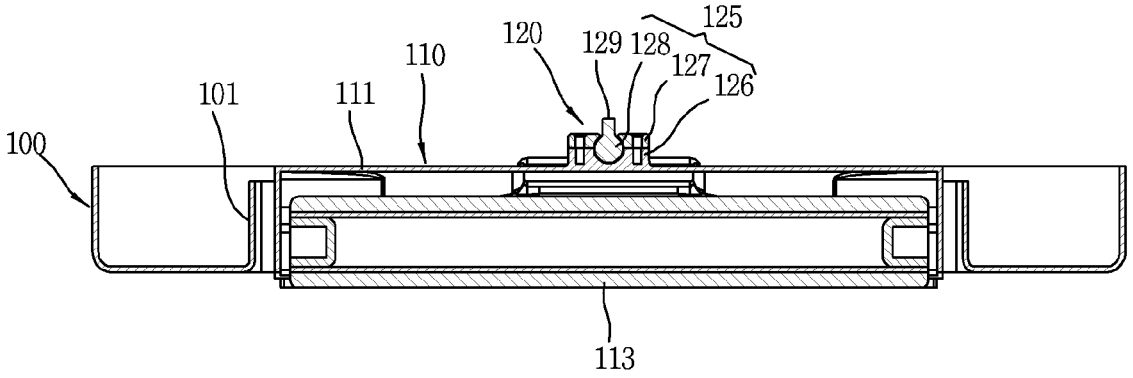
FIG. 4 is a sectional front view illustrating the suction nozzle mounted to be suspended by a ball joint, taken along line IV-IV in FIG. 1.
Figure 5:
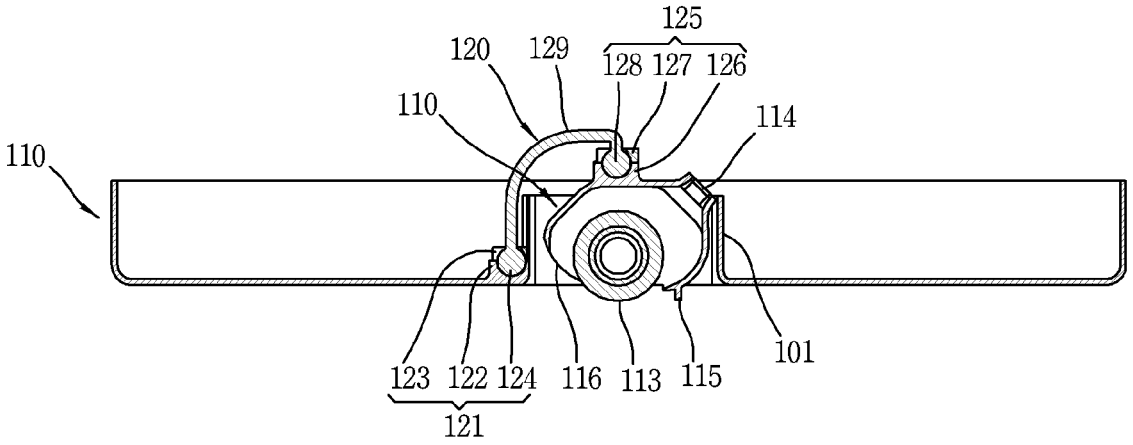
FIG. 5 is a sectional side view illustrating the suction nozzle mounted to be suspended by the ball joint, taken along line V-V in FIG. 1.
Figure 6:
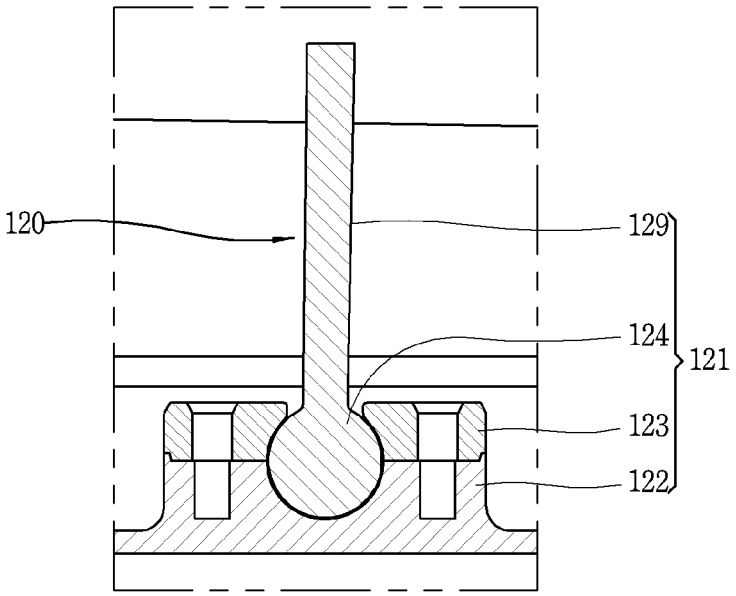
FIG. 6 is a sectional rear view illustrating a ball portion provided in a joint housing, taken along line VI-VI in FIG. 1.

Lower (in FIG. 3) front and rear ends of the suction nozzle 110 may have a round or tapered portion or edge 116 (FIG. 3). The round portion 116 may reduce a possibility of the suction nozzle 110 being caught on the floor due to a change in height of the floor or encountering an obstacle lying along a traveling path when moving forward or backward on the floor.

The suction nozzle 110 may be suspended from an upper portion of a supporter or support 120. The suction nozzle 110 may be mounted to be movable up and down with respect to the cleaner main body 100. The suction nozzle 110 may be configured to swing or pivot in a front-rear direction and the left-right direction via the supporter 120. The support 120 may include first and second ball joints 121 and 125 and a connecting bar 129, which is pliable, described in more detail with reference to FIGS. 3-6. Due to rotation at the ball joints 121 and 125 and a pliability of the connecting bar 129, a motion of the suction nozzle 110 may be described as a swinging, rocking, oscillating, or pivoting motion. The robot cleaner may also include a nozzle body 111, a suction port 112, an agitator 113, and a flow path connection portion 114 described in more detail with reference to FIGS. 3-6.

Referring to FIGS. 3-6, the suction nozzle 110 may be configured to suck or suction foreign substances from a floor that lie along a traveling path of the robot cleaner. The nozzle body 111 may have a length extending in the left-right direction of the cleaner main body 100 and configured to be received in the accommodating portion 101. The nozzle body 111 may have an accommodation space formed therein.

The suction port 112 may be formed at a lower surface of the nozzle body 111. The suction port 112 may be provided inside the communication hole, and may be formed to communicate with a floor on a traveling path. The suction port 112 may be configured to suck foreign substances and air into the nozzle body 111.

The agitator 113 may be rotatably mounted to the suction port 112 of the nozzle body 111, and may alternatively be referred to as a roller. Shaft support grooves may be concave at both (i.e., left and right) ends of the agitator 113. A rotation shaft may protrude from each of the inner side surfaces of both (i.e., left and right) side walls of the nozzle body 111. The rotation shaft may be provided in the shaft support grooves, and the agitator 113 may be rotatably mounted inside both side walls of the nozzle body 111. The nozzle body 111 and/or the suction nozzle 110 may alternatively be referred to as an agitator case or support.

The agitator 113 may be configured to be rotated by a separate motor for the agitator 113. The agitator 113 may be formed in a cylindrical shape whose length is longer than its diameter. A plurality of blades may be provided on an outer circumferential surface of the agitator 113. The plurality of blades may be spaced apart from each other in a circumferential direction.

As the agitator 113 rotates, the plurality of blades may be configured to sweep away foreign substances accumulated on or attached to the floor while sweeping up the foreign substances through the suction port 112. A brush may be further provided on or between the plurality of blades. The brush may brush off foreign substances attached to the floor or sweep the foreign substances up through the suction port 112.

An auxiliary brush 115 may be installed behind the suction port 112 of the suction nozzle 110. The auxiliary brush 115 may be provided vertically in an up-down direction to brush off foreign substances on the floor or sweep foreign substances in a traveling direction.

The flow path connection portion 114 may be formed at a rear upper portion of the suction nozzle 110 and may be configured to transfer foreign substances to a dust collector or a dust bin. The flow path connection portion 114 may have a flow path outlet of the suction nozzle 110.

The flow path connection portion 114 may communicate with the accommodation space of the nozzle body 111. The flow path connection portion 114 may have an area that is gradually reduced from an upper rear portion of the nozzle body 111 to the flow path outlet.

As the area of the flow path connection portion 114 gradually decreases toward the flow path outlet, a flow velocity of the suctioned air containing foreign substances may be gradually increased.

The suction nozzle 110 may contact the floor so that foreign substances on the floor on the traveling path can be quickly sucked into the accommodation space of the nozzle body 111. The suction nozzle 110 may be connected to be communication with a suction fan that suctions air through the flow path connection portion 114 to form suction pressure of air. The suction fan may be connected to a suction motor to be rotated by the suction motor.

The dust collector may be mounted inside the cleaner main body 100. The dust collector may be connected to be in communication with the suction nozzle 110 and may be configured to collect foreign substances in the air suctioned through the suction nozzle 110.

A structure of the suction nozzle 110 may be configured to reduce or minimize a possibility of being caught on the floor caused by a difference in height of the floor according to changes in an environment of the floor during traveling. The suction nozzle 110 may be mounted to be movable up and down with respect to the cleaner main body 100. The suction nozzle 110 may freely move up and down according to changes in the height of the floor.

An initial or default position or height of the suction nozzle 110 of the present disclosure with respect to a height between the floor and the nozzle body 111 may be set or predetermined based on a hard floor such as a floor plate. The suction nozzle 110 may be configured to swing or pivot in the front-rear direction with respect to the traveling direction. Swing refers to a rotation within a predetermined angle range in the circumferential direction.

The suction nozzle 110 may be configured to perform a variable operation or a swing operation in which a climbing angle of the suction nozzle 110 may be inclined, so that the suction nozzle 110 may actively or effectively operate even when a height of the floor changes greatly. The suction nozzle 110 of the present disclosure may be referred to as a floating nozzle. The floating nozzle may refer to a nozzle capable of moving up and down according to a change in a height of a floor or capable of swinging in the front-rear direction and the left-right direction.

The floating nozzle described in the present disclosure may be applied not only to a robot cleaner but also to a manual vacuum cleaner or other cleaner that collects foreign substances via suctioned air.

The supporter 120 may include a plurality of ball joints and a connecting bar 129 to support the suction nozzle 110 and enable the suction nozzle 210 to move up and down or swing. The suction nozzle 110 may be coupled to the cleaner main body 100 by the ball joint. The suction nozzle 110 may be supported to be able to move up and down or swing with respect to the cleaner main body 100 by the ball joint.

The ball joint may include a first ball joint 121 and a second ball joint 125. Alternatively, if necessary, only one of the first ball joint 121 and the second ball joint 125 may be applied. For convenience of description, and embodiment where both the first ball joint 121 and the second ball joint 125 are applied will be described.

The first ball joint 121 may be provided at the cleaner main body 100. The second ball joint 125 may be provided at the suction nozzle 110. Both the first ball joint 121 and the second ball joint 125 may include components that are the same as or similar each other. Accordingly, in this embodiment, the components and/or description of the first ball joint 121 may be commonly applied to the second ball joint 125.

However, the first ball joint 121 and the second ball joint 125 may be different in that they may be applied to different positions. The first ball joint 121 may be referred to as a lower ball joint according to an arrangement relationship shown in FIG. 3. The second ball joint 125 may be referred to as an upper ball joint. The second ball joint 125 may be provided higher than the first ball joint 121 in the view shown in FIG. 3.

The first ball joint 121 may be located at a lower surface of the cleaner main body 100 and the second ball joint 125 may be located at an upper portion of the suction nozzle 110. The first ball joint 121 may be provided inside the cleaner main body 100 at a position outside the accommodating portion 101. The first ball joint 121 may be provided at a front center of a front surface of the accommodating portion 101 in front of the suction nozzle 110.

The second ball joint 125 may be provided at the upper portion of the suction nozzle 110. The second ball joint 125 may be provided on an upper center of the suction nozzle 110.

The first ball joint 121 may be located at a center of the accommodating portion 101, and the second ball joint 125 may be located at a center of the suction nozzle 110. Here, the center of the accommodating portion 101 and the center of the suction nozzle 110 may refer to a center with respect to a lengthwise direction.

The first ball joint 121 may be located at the center of the accommodating portion 101 and the second ball joint 125 may be located at the center of the suction nozzle 110 to prevent a difference in suction performance caused by a difference in heights from the floor at each end portion of the suction nozzle 110 when a left end portion and a right end portion of the suction nozzle 110 swing in the left-right direction. Both end portions of the suction nozzle 110 may be spaced apart from the second ball joint 125 by similar or identical distances in the lengthwise direction of the suction nozzle 110.

The first ball joint 121 may include a first joint housing 122, a first ball portion or ball 124, and a first joint cover 123. The first joint housing 122 may be provided at the lower surface of the cleaner main body 100 and may be configured to guide a rolling of the first ball portion 124 via a guide groove formed in the first joint housing 122.

The guide groove may be formed in a shape corresponding to the first ball portion 124. For example, the first ball portion 124 may have a round or spherical (e.g., hem i-spherical, demi-spherical, or fully spherical) shape, and the guide groove may be formed in a similar round or spherical shape. An upper portion of the guide groove may be opened. The first ball portion 124 may be provided inside the first joint housing 122.

The first joint cover 123 may be coupled to an upper portion of the first joint housing 122 to cover the upper portion of the first joint housing 122 that may be opened. Coupling holes may be formed at both sides of the first joint cover 123 and at both sides of the first joint housing 122 so that the first joint cover 123 and the first joint housing 122 may be coupled by coupling members (e.g., screws or bosses) inserted through the coupling holes.

A guide groove may be formed at an inner side of the first joint cover 123. The guide groove of the first joint cover 123 may also be formed in a round or spherical shape, like the guide groove of the first joint housing 122. The first joint cover 123 may be configured to cover an upper portion of the first ball portion 124 to prevent the first ball portion 124 from being separated from the first joint housing 122.

The guide groove of the first joint housing 122 and the guide groove of the first joint cover 123 may together form a single spherical shape to surround an outer circumferential surface of the first ball portion 124. A cutout portion 1231 may be formed in the first joint cover 123 to be opened toward the connecting bar 129. The cutout portion 1231 may be provided to allow one side of the connecting bar 129 extending from the first ball portion 124 to protrude upward and connect the first ball portion 124 and a second ball portion or ball 128 when the first ball portion 124 is provided in the first joint housing 122, and to allow the first joint cover 123 to be easily assembled to the upper portion of the first joint housing 122. According to this configuration, the first ball portion 124 may roll in the front-rear direction with respect to the first joint housing 122 along the guide groove in the first joint housing 122.

The second ball joint 125 may include a second joint housing 126, the second ball portion 128, and a second joint cover 127. The second joint housing 126, the second ball portion 128, and the second joint cover 127 may also be configured equally or similarly to the first joint housing 122, the first ball portion 124, and the first joint cover 123. In addition, a cutout portion 1271 may be formed in the second joint cover 127 to be opened toward the connecting bar 129. The first and second ball portions 124 and 128 may alternatively be referred to as first and second rounded heads. The second joint housing 126 may be provided on the upper portion of the suction nozzle 110, the second ball portion 128 may be provided inside the second joint housing 126, and the second joint cover 127 may be coupled to an upper portion of the second joint housing 126 by a coupling member.

The first ball portion 124 and the second ball portion 128 may be connected to each other by the connecting bar 129. One (e.g., a first) side or end of the connecting bar 129 may be connected to the upper portion of the first ball portion 124, and another (e.g., a second) side or end of the connecting bar 129 may be connected to an upper portion of the second ball portion 128.

The connecting bar 129 may extend from the first ball portion 124 to the second ball portion 128. A vertical portion may be vertically extended at the first side of the connecting bar 129. A horizontal portion may be horizontally extended at the second side of the connecting bar 129. A curved portion may be extended at a middle of the connecting bar 129 by being curved at a predetermined curvature so as to connect an upper end of the vertical portion and one end of the horizontal portion. An extending portion extending downwardly from another end of the horizontal portion may be formed to connect the second ball portion 128 and the extending portion.

The first ball portion 124, the connecting bar 129, and the second ball portion 128 may be connected to each other in one body. The second side of the connecting bar 129 may be curved in the front-rear direction and the up-down direction with respect to the first side of the connecting bar 129. The connecting bar 129 may have an elastically deformable structure. For example, the connecting bar 129 may be made of a flexible or pliable material.

Figure 7A:
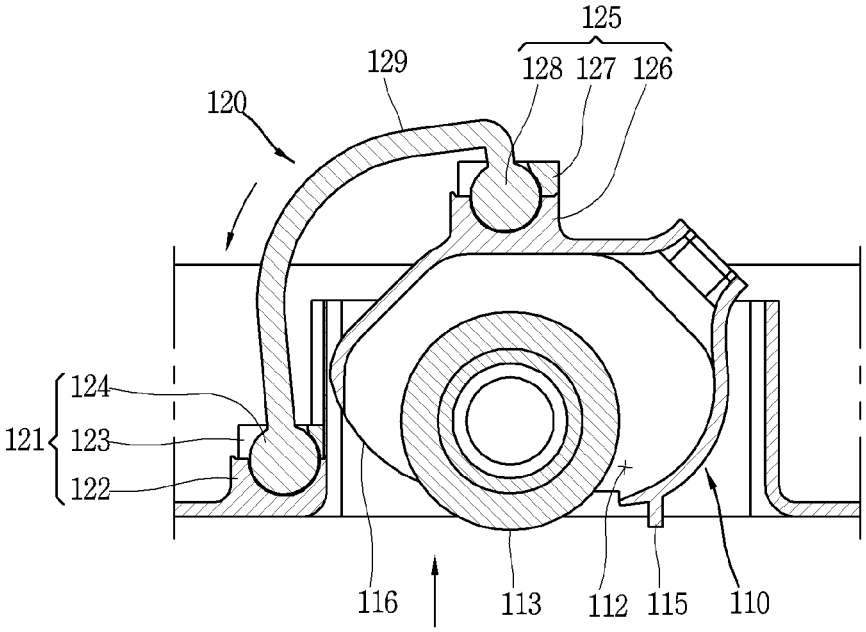
FIGS. 7A and 7B are operation state views illustrating a state in which the suction nozzle moves up and down with respect to the cleaner main body of FIG. 4.

Referring to FIG. 7A, FIG. 7A illustrates where the suction nozzle 110 may be moved up with respect to the cleaner main body 100. The supporter 120 may support the suction nozzle 110 to be upwardly movable.

For example, when the cleaner main body 100 travels on a floor with a relatively higher height, such as a carpet, the suction nozzle 110 may receive an upward pressure from the floor. An upper portion of the connecting bar 129 of the supporter 120 may be configured to rotate about the first ball joint 121 by an upward pressure. The first ball portion 124 may roll counterclockwise with respect to the first joint housing 122. The upper portion of the connecting bar 129 may be elastically deformed upwardly. According to this configuration, the suction nozzle 110 may be moved up according to a height of a floor.

Figure 7B:
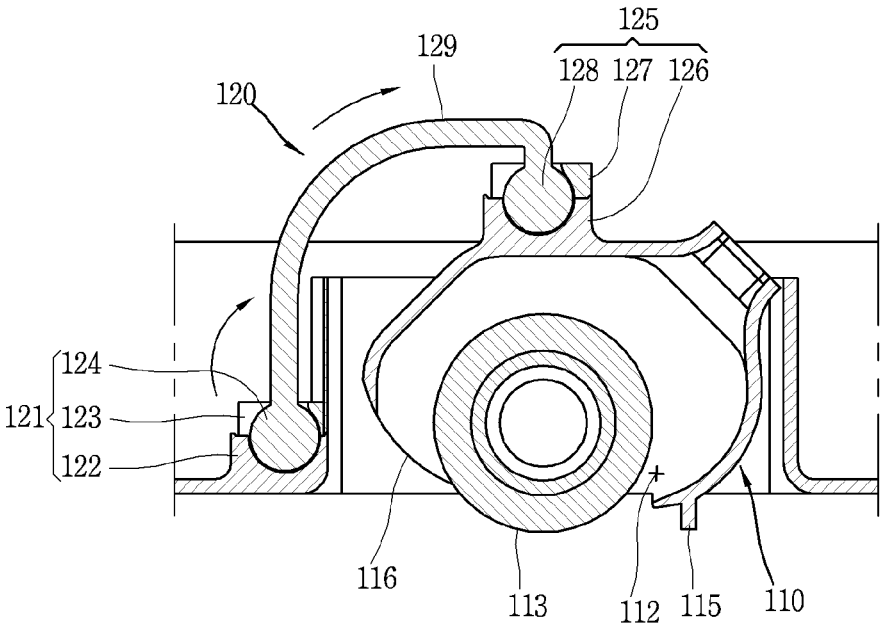

Referring to FIG. 7B, when the cleaner main body 100 travels from a carpet or other higher flooring to a floor having a relatively low surface, such as a hard floor or a general floor, an upward pressure may be released as the cleaner main body 100 moves to the lower floor. The upper portion of the connecting bar 129 of the supporter 120 may move to an initial or original position by rotating in an opposite direction about the first ball joint 121. The first ball portion 124 may roll clockwise with respect to the first joint housing 122. The upper portion of the connecting bar 129 may return to its original position by an elastic force. According to this configuration, the suction nozzle 110 may move down to an initial or original position when traveling to a lowered general floor.

Figure 8:
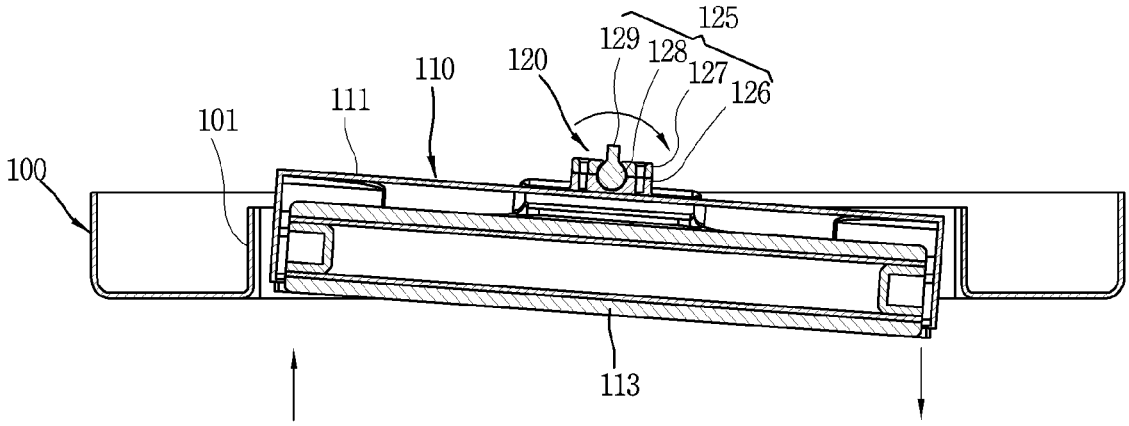
FIG. 8 is an operation state view illustrating a state in which the suction nozzle partially moves up and down with respect to the cleaner main body of FIG. 5.

Referring to FIG. 8, a left side and a right side of the suction nozzle 110 may receive different upward pressures from the floor depending on a position of a floor while the cleaner main body 100 may be traveling. For example, when a left wheel of the driving wheels 102 (FIG. 2) may be located on a higher floor and a right wheel of the driving wheels may be located on a lower floor, the left side of the suction nozzle 110 may move up, and the right side of the suction nozzle 110 may move down (partial up-down movement) with respect to a central portion of the suction nozzle 110 in a lengthwise direction, that is, the second ball joint 125.

The suction nozzle 110 may rotate in a left-right direction (clockwise direction in FIG. 8) about the second ball joint 125 with respect to the cleaner main body 100. The second joint housing 126 may roll in a left-right direction with respect to the second ball portion 128. The second joint housing 126 may roll in a clockwise direction with respect to the second ball portion 128. Similarly, when the right wheel of the driving wheels 102 may be located on a higher floor and the left wheel of the driving wheels 102 may be located on a lower floor, the suction nozzle 110 may swing in the left-right direction with respect to the cleaner main body 100.

Figure 9A:
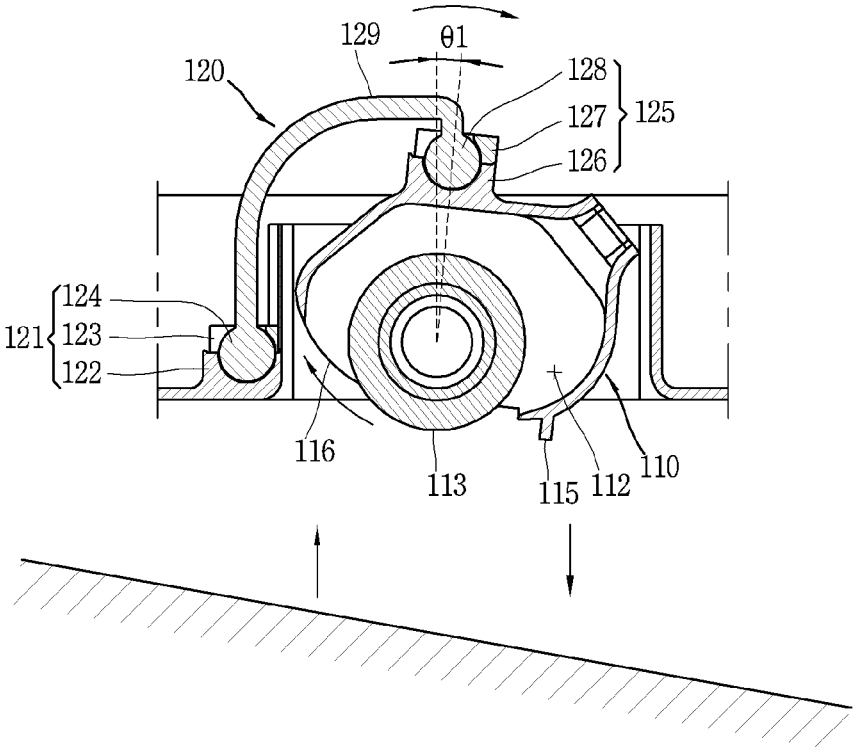
FIGS. 9A to 9C are operation state views illustrating a state in which the suction nozzle swings in a front-rear direction with respect to the cleaner main body of FIG. 5.
Figure 9B:
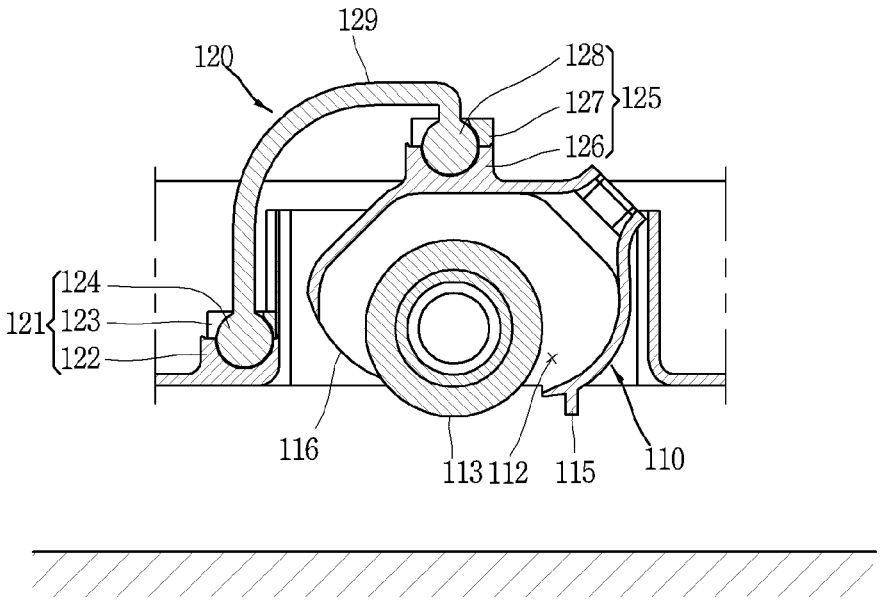

Referring to FIGS. 9A and 9B, when the cleaner main body 100 travels on an uphill slope or a downhill slope, upward pressures received by a front end portion and a rear end portion of the suction nozzle 110 may be different. For example, referring to FIG. 9A, when the cleaner main body 100 travels on an uphill slope, the front end portion of the suction nozzle 110 may receive a higher upward pressure than the rear end portion of the suction nozzle 110.

The suction nozzle 110 may swing in a front-rear direction about the second ball joint 125. The suction nozzle 110 may swing such that the front end portion of the suction nozzle 110 moves up and the rear end portion of the suction nozzle 110 moves down. The suction nozzle 110 may rotate by a rotation angle of θ1. The second joint housing 126 may roll in a clockwise direction about the second ball portion 128.

Referring to FIG. 9B, when the cleaner main body 100 travels on a flat floor, the front end portion and the rear end portion of the suction nozzle 110 may be in a neutral state without inclining to either side in the front-rear direction.

Figure 9C:
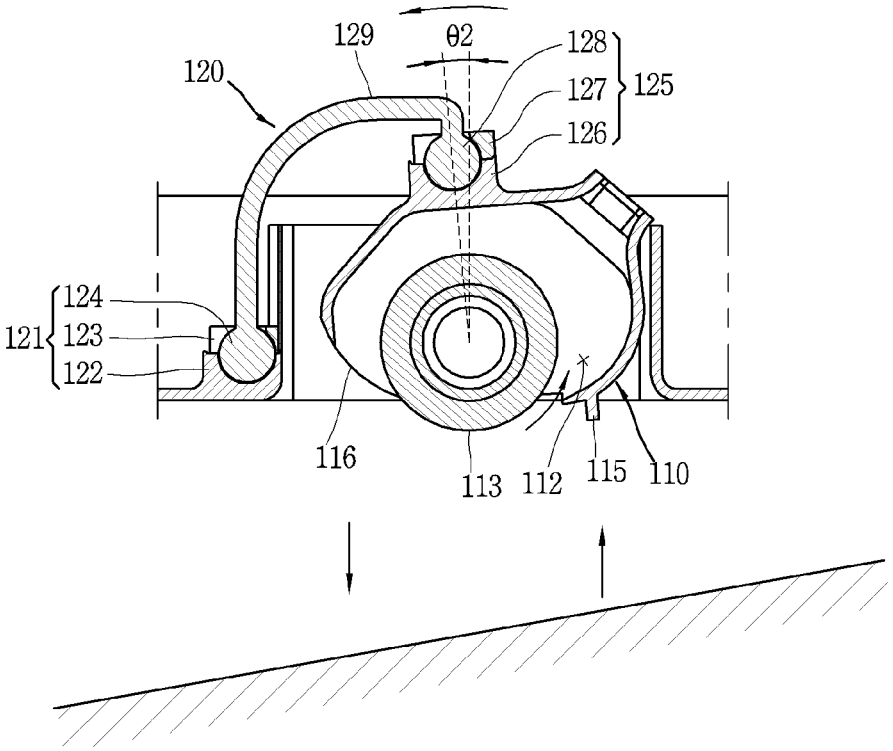

Referring to FIG. 9C, when the cleaner main body 100 descends on a downhill slope or climbs backward, the rear end portion of the suction nozzle 110 may receive an upward pressure greater than an upward pressure that the front end portion of the suction nozzle 110 may receive. The suction nozzle 110 may swing in the front-rear direction about the second ball joint 125. The suction nozzle 110 may swing such that the rear end portion of the suction nozzle 110 moves up and the front end portion of the suction nozzle 110 moves down. The suction nozzle 110 may rotate by a rotation angle of θ2. The second joint housing 126 may roll in a counterclockwise direction about the second ball portion 128.

According to the present disclosure, the supporter 120 may be provided between the cleaner main body 100 and the suction nozzle 110, and may be configured to support the suction nozzle 110 with the ball joint provided at a portion connected to the cleaner main body 100 or to the suction nozzle 110 to be able to swing in the front-rear direction and the left-right direction or move up and down. The suction nozzle 110 can actively respond to changes in the height of the floor, thereby improving travel performance.

In addition, the ball joint may include the first ball joint 121 at the cleaner main body 100 and the second ball joint 125 at the suction nozzle 110. The first ball joint 121 may support the suction nozzle 110 to be able to move up and down, and the second ball joint 125 may support the suction nozzle 110 to be able to swing in the front-rear direction and the left-right direction.

The ball joint may include the joint housing and the ball portion. The joint housing may include the first joint housing 122 provided at the cleaner main body 100 and the second joint housing 126 provided at the suction nozzle 110. The ball portion may include the first ball portion 124 provided in the first joint housing 122 and the second ball portion 128 provided in the second joint housing 126. Each of the first ball portion 124 and the second ball portion 128 may perform joint motion by rolling along a guide groove formed in the first joint housing 122 and second joint housing 126, respectively.

As the first ball portion 124 rolls in the front-rear direction and the left-right direction with respect to the first joint housing 122, the suction nozzle 110 may move up and down or partially move up and down. As the second ball portion 128 rolls in the front-rear direction and the left-right direction with respect to the second joint housing 126, the suction nozzle 110 may swing in the front-rear direction and the left-right direction by the second ball joint 125.

The first ball joint 121 may be located at the lower surface of the cleaner main body 100, the second ball joint 125 may be located at an upper portion the suction nozzle 110, and the supporter 120 may be provided with the connecting bar 129 extending from the first ball portion 124 to the second ball portion 128 to support the suction nozzle 110 with a structure of the suction nozzle 110 being suspended. Each of the first ball portion 124 and the second ball portion 128 may be formed in a shape of a sphere so that the suction nozzle 110 may easily follow or adjust to a climbing angle and a height difference according to a floor environment.

Figure 10:
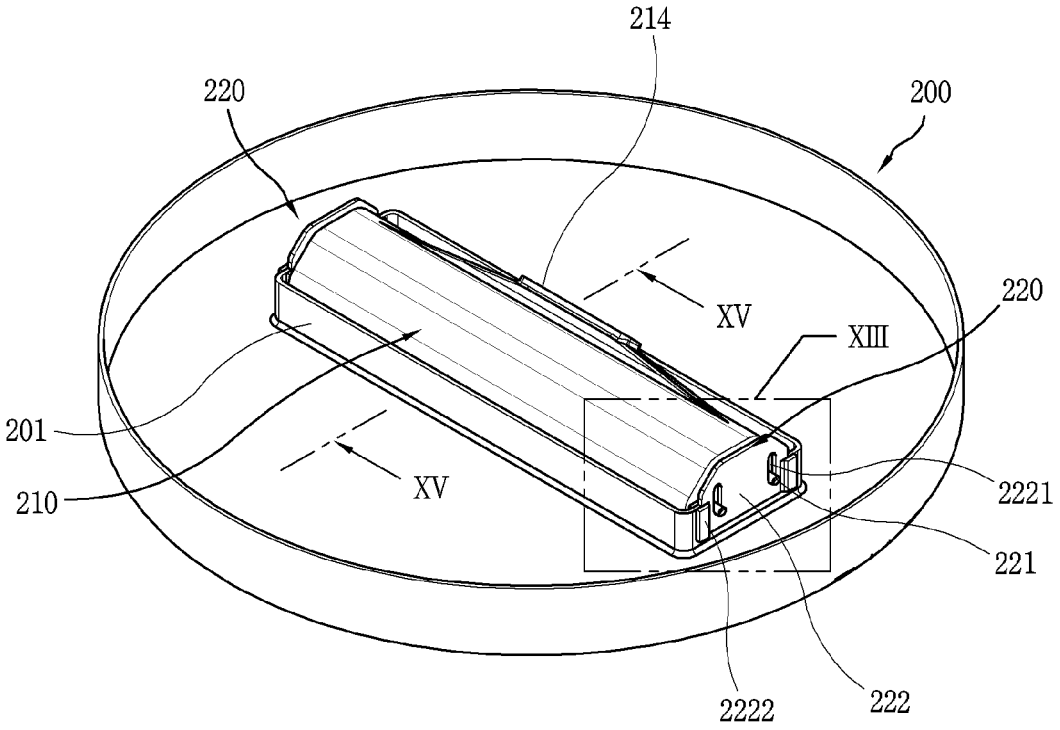
FIG. 10 is a conceptual view illustrating a state in which a suction nozzle according to a second embodiment of the present disclosure is mounted on a cleaner main body of a robot cleaner.
Figure 11:
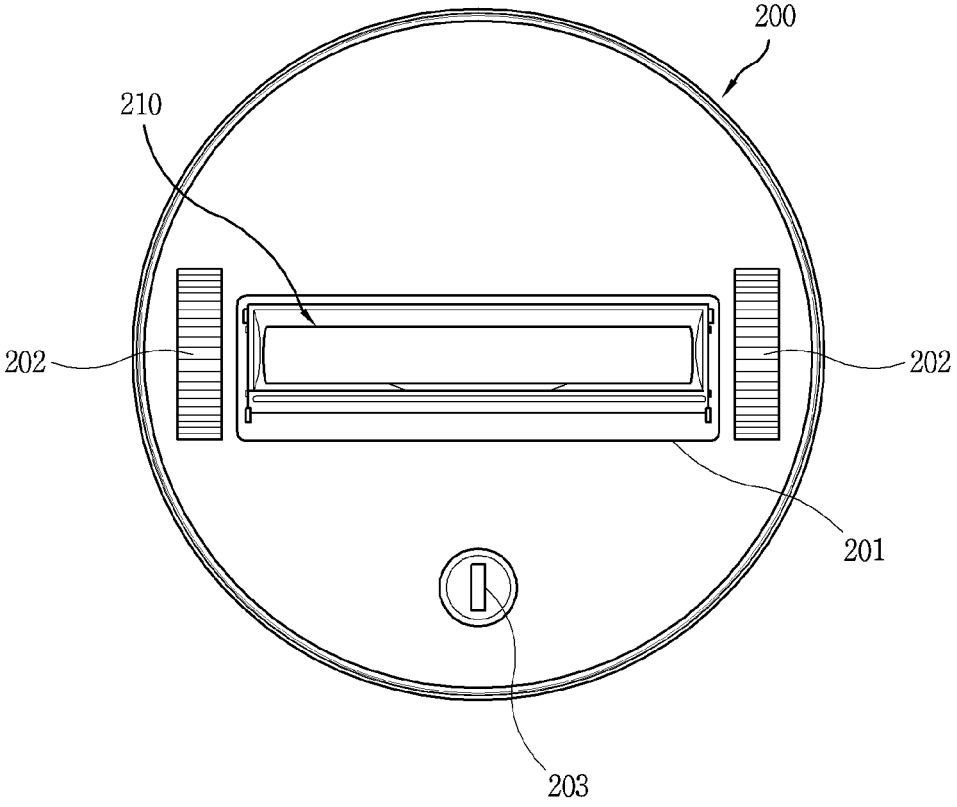
FIG. 11 is a bottom view illustrating a bottom surface of the cleaner main body of FIG. 10.

Referring to FIGS. 10-11, a robot cleaner according to another embodiment may include a cleaner main body 200, a wheel unit, and a suction nozzle 210. The cleaner main body 200 may define an appearance or an exterior surface of the robot cleaner. The cleaner main body 200 may be formed in a flat cylindrical or disc shape whose height may be relatively small compared to its diameter.

The wheel unit may include a plurality of driving wheels 202 and an auxiliary wheel 203. The plurality of driving wheels 202 may be rotatably mounted on the cleaner main body 200 to move the robot cleaner. The plurality of driving wheels 202 may be configured to allow the robot cleaner to travel autonomously. The plurality of driving wheels 202 may be provided on a left side and a right side of the cleaner main body 200, respectively.

Each of the plurality of wheels 202 may be connected to a wheel driving motor. The wheel driving motor may be configured to independently drive each of the plurality of driving wheels 202. As a rotation speed of the wheel driving motor may be controlled, the driving wheel 202 on the left side and the driving wheel 202 on the right side may be rotated at different speeds. As each of the driving wheels 202 may be independently operated, steering such as left and right turning and forward and backward movements of the robot cleaner may be performed.

The auxiliary wheel 203 may be rotatably installed at a front side or a rear side of the cleaner main body 200. The auxiliary wheel 203 may assist the driving wheels 202 to facilitate steering of the cleaner main body 200.

An accommodating portion or protrusion 201 may be provided in the cleaner main body 200. The accommodating portion 201 may be configured to receive the suction nozzle 210. The accommodating portion 201 may be provided at a central portion of the cleaner main body 200.

The accommodating portion 201 may be penetrated to communicate with a floor on which the cleaner main body 200 travels. The accommodating portion 201 may be formed in a rectangular shape whose left-right length may be longer than its front-rear width or up-down height. A long horizontal or left-right surface of the accommodating portion 201 may form a right angle with a short front-rear surface of the accommodating portion 201.

The accommodating portion 201 may be formed to be long in a direction crossing a traveling direction of the cleaner main body 200. The accommodating portion 201 may have a rectangular shape and may be formed to protrude upward from a lower surface of the cleaner main body 200.

In this specification, front, rear, or a front-rear direction of each component are determined with respect to the traveling direction of the cleaner main body 200. In this specification, a left-right direction of each component refers to a direction crossing the traveling direction of the cleaner main body 200.

For example, a lateral direction of the accommodating portion 201 may refer to a direction crossing the traveling direction of the cleaner main body 200 when traveling straight. Alternatively, a front-rear direction of the accommodating portion 201 may refer to a direction parallel to the traveling direction of the cleaner main body 200 when traveling straight.

The suction nozzle 210 may be configured to suction foreign substances from a floor along a traveling path. The suction nozzle 210 may be formed in a rectangular shape whose horizontal or left-right length may be longer than its front-rear width when viewed from above. However, the suction nozzle 210 may be formed to have a size smaller than that of the accommodating portion 101 and may be provided inside the accommodating portion 201.

When the suction nozzle 210 is provided inside the accommodating portion 201, each of front and rear surfaces and left and right surfaces of the suction nozzle 210 may be spaced apart from each of front and rear surfaces and left and right surfaces of the accommodating portion 201. However, in order to increase or maximize a suction pressure and an amount of suctioned air of the suction nozzle 210, each of the front and rear surfaces and the left and right surfaces of the suction nozzle 210 may be provided adjacent to each of front and rear surfaces and left and right surfaces of the accommodating portion 201.

A round or tapered portion 216 may be formed at a lower front end portion and/or at a lower rear end portion of the suction nozzle 210, respectively. With this configuration, the round portion 216 may reduce a possibility of the suction nozzle 210 catching on the floor when moving forward or backward on the floor on the traveling path.

Figure 15:
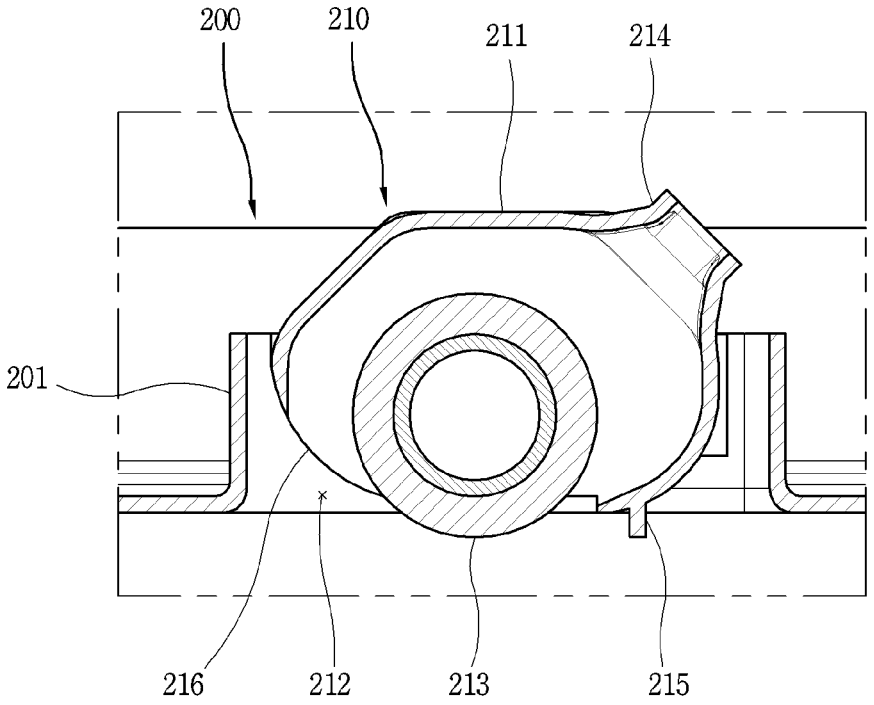
FIG. 15 is a sectional view, taken along line XV-XV in FIG. 10.
Figure 16:
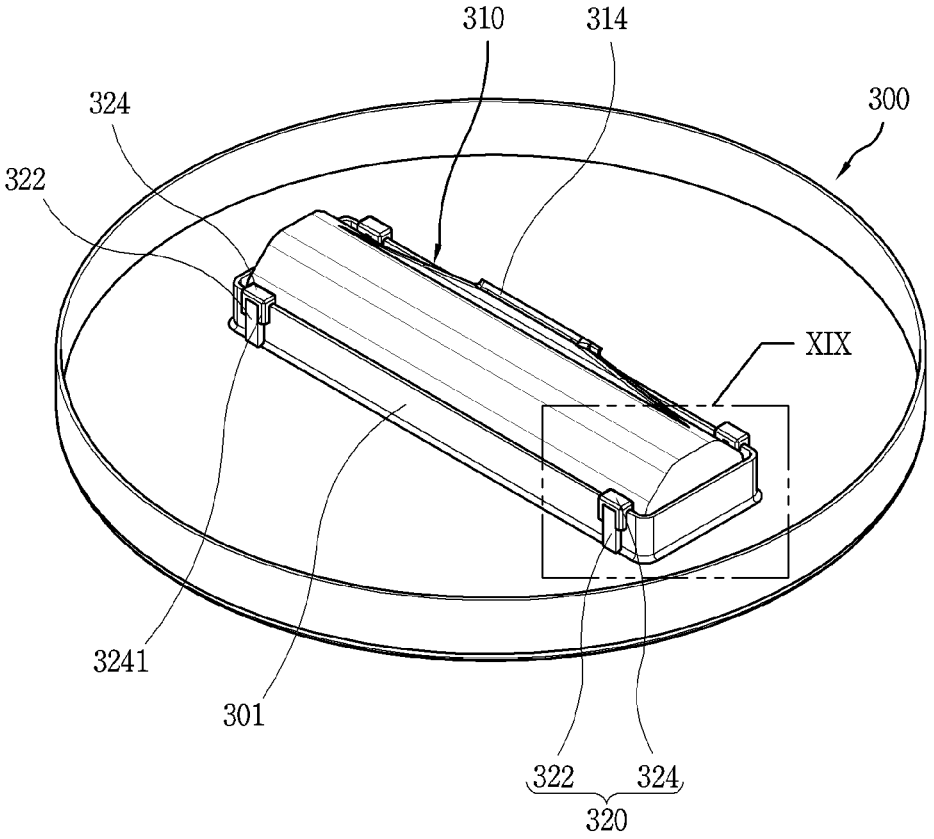
FIG. 16 is a conceptual view illustrating a state in which a suction nozzle according to a third embodiment of the present disclosure is mounted on a cleaner main body of a robot cleaner.
Figure 17:
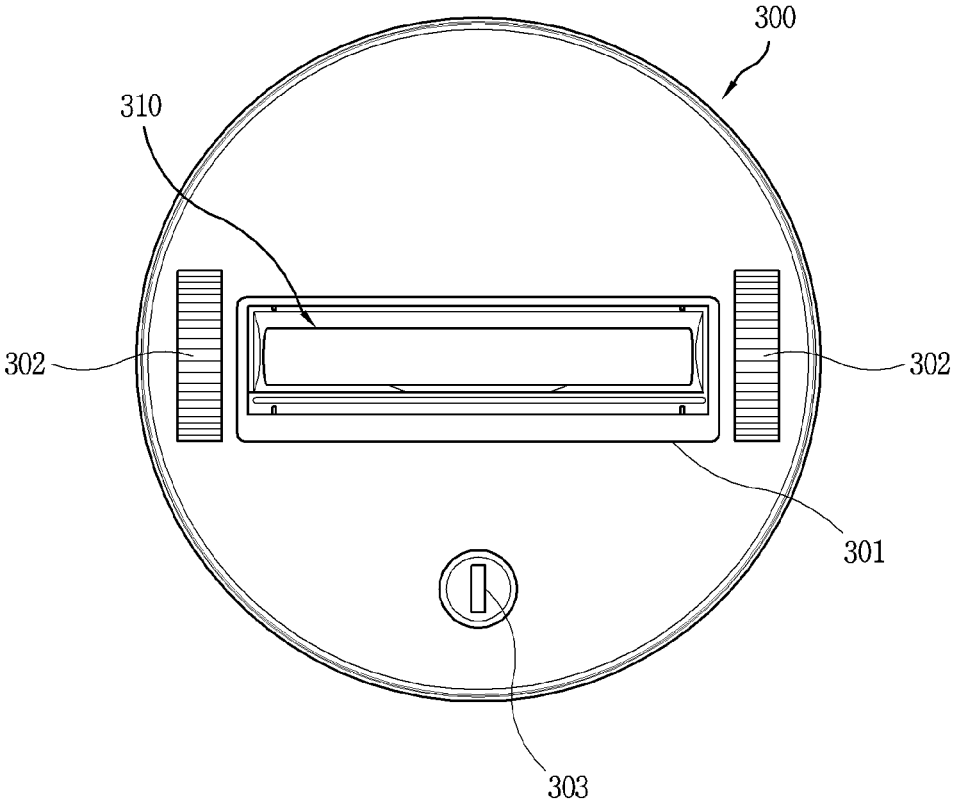
FIG. 17 is a bottom view illustrating a bottom surface of the cleaner main body to which the suction nozzle is mounted in FIG. 16.
Figure 18:
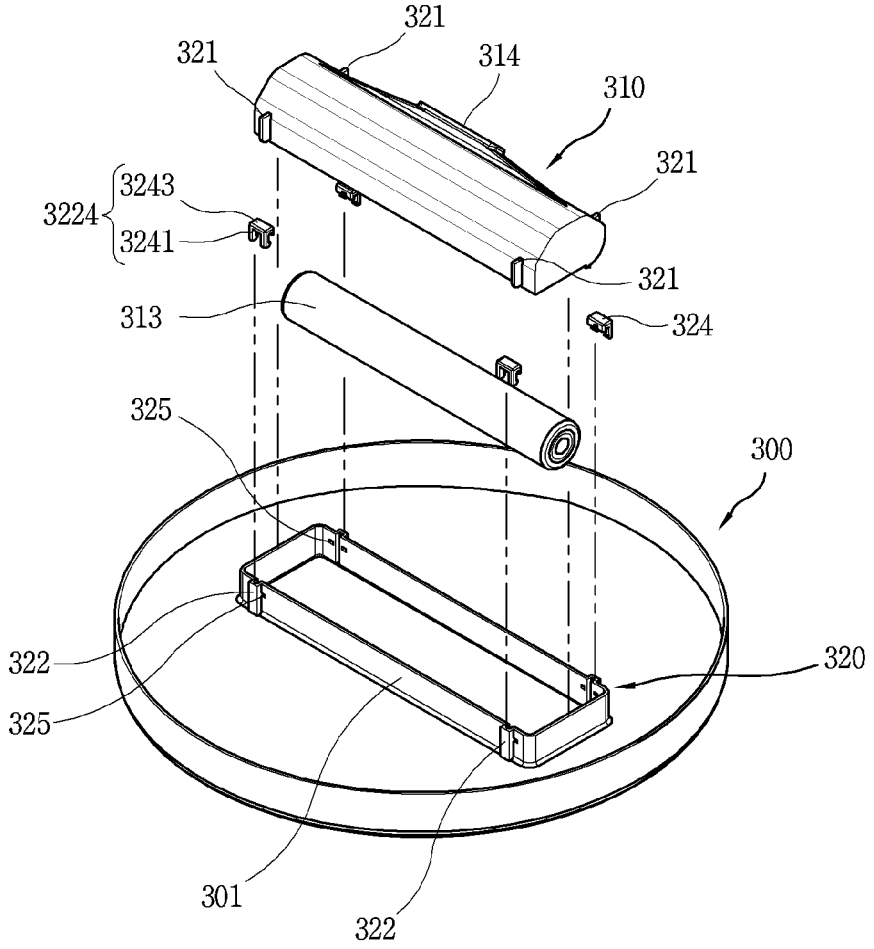
FIG. 18 is an exploded view illustrating a state in which the suction nozzle is disassembled from the cleaner main body of FIG. 16.
Figure 19:
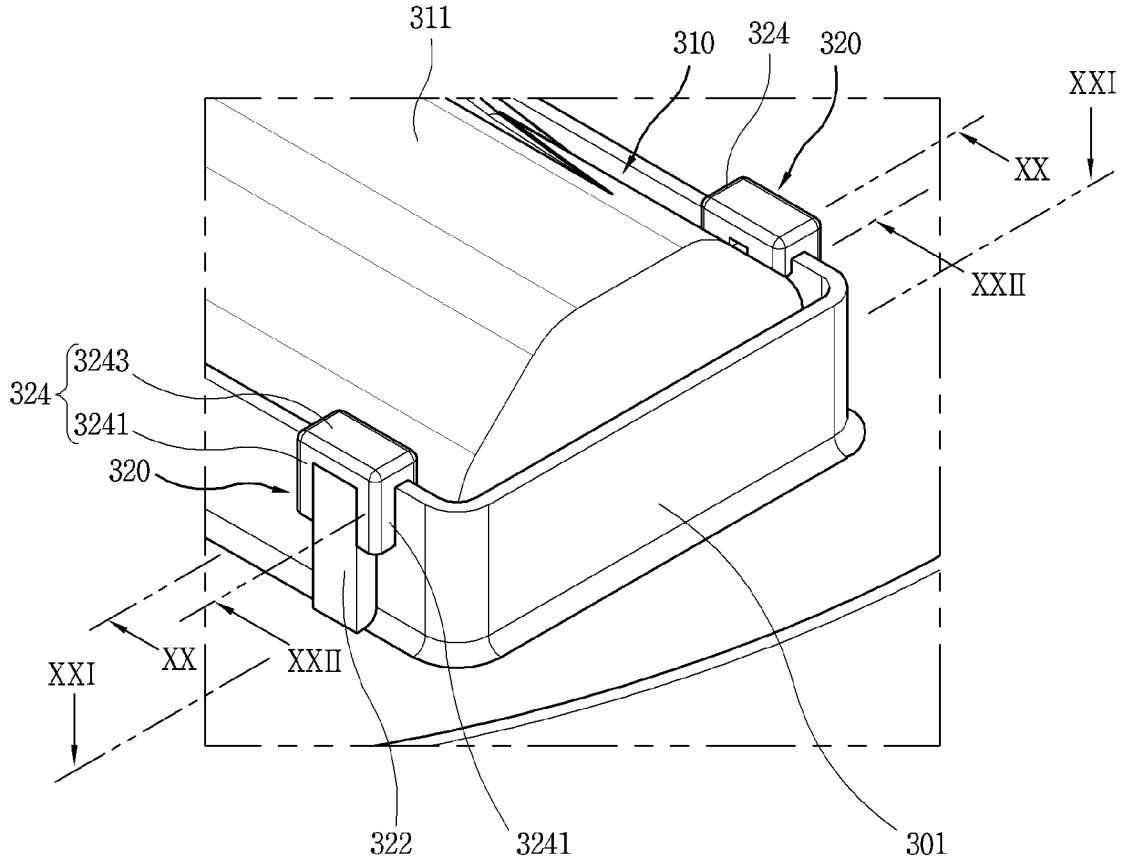
FIG. 19 is an enlarged view of a part "XIX" in FIG. 16.

The suction nozzle 210 may include a nozzle body 211, a suction port 212 (FIG. 15), an agitator 213, and a flow path connection portion 214. The nozzle body 211 may have a length extending in the left-right direction of the cleaner main body 200 to be provided in the accommodating portion 201. The nozzle body 211 may have an accommodation space formed therein.

The suction port 212 may be formed at a lower surface of the nozzle body 211. The suction port 212 may be provided inside the accommodating portion, and may be formed to communicate with a floor on a traveling path. The suction nozzle 210 may be configured to suction foreign substances and air on the floor on the traveling path through the suction port 212 into the nozzle body 211.

The agitator 213 may be rotatably mounted to the suction port 212 of the nozzle body 211. Shaft support grooves may be concave at both (i.e., left and right) ends of the agitator 213. A rotation shaft may protrude from each of inner side surfaces of both (i.e., left and right) side walls of the nozzle body 211. The rotation shaft may be provided in the shaft support grooves, and the agitator 213 may be rotatably mounted inside both side walls of the nozzle body 211.

The agitator 213 may be configured to be rotated by a separate motor for the agitator 213. The agitator 213 may be formed in a cylindrical shape whose length in the lateral direction of the nozzle body 211 may be longer than its diameter. A plurality of blades may be provided on an outer circumferential surface of the agitator 213. The plurality of blades may be spaced apart from each other in a circumferential direction.

As the agitator 213 rotates, the plurality of blades may sweep away foreign substances accumulated on or attached to the floor while sweeping up the foreign substances through the suction port 212. A brush may be further provided between the plurality of blades. The brush may brush off foreign substances attached to the floor or sweep the foreign substances up through the suction port 212.

An auxiliary brush 215 may be installed behind the suction port 212 of the suction nozzle 210. The auxiliary brush 215 may be provided vertically in the up-down direction to brush off foreign substances on the floor or sweep foreign substances in the traveling direction.

The flow path connection portion 214 may be formed at a rear upper portion of the suction nozzle 210 and may be configured to transfer foreign substances in suctioned air to a dust collector or bin. The flow path connection portion 214 may form a flow path outlet of the suction nozzle 210.

The flow path connection portion 214 may communicate with the accommodation space of the nozzle body 211. The flow path connection portion 214 may be formed such that an area thereof is gradually reduced from an upper rear portion of the nozzle body 211 to the flow path outlet. As the area of the flow path connection portion 214 gradually decreases toward the flow path outlet, a flow velocity of the suctioned air containing foreign substances may be gradually increased.

In the suction nozzle 210, a lower surface of the nozzle body 211 may be provided adjacent to the floor so as to rapidly suction foreign substances from the floor along the traveling path into the accommodation space of the nozzle body 211. As the outer circumferential surface of the agitator 213 provided in the suction nozzle 210 may be provided to contact the floor, the agitator 213 may receive an upward pressure from the floor according to a change in a height of the floor.

The suction nozzle 210 may be connected to be in communication with a suction fan to suction air through the flow path connection portion 214 to form suction pressure of air. The suction fan may be connected to a suction motor to be rotated by the suction motor.

The dust collector may be mounted inside the cleaner main body 200. The dust collector may be connected to be in communication with the suction nozzle 210 and may be configured to collect foreign substances in the air suctioned through the suction nozzle 210.

The suction nozzle 210 may reduce or minimize a possibility of being caught due to a height difference along a floor according to changes in an environment or type of floor during traveling. The suction nozzle 210 may be mounted to be movable up and down relative to the cleaner main body 200 according to a change in the height of the floor.

Although the robot cleaner described with reference to FIGS. 10-15 may be similar to the robot cleaner described with reference to FIGS. 1-9C, the robot cleaner may differ in its implementation of a supporter or support 220. The supporter 220 may include a plurality of guide protrusions 221 and a plurality of guide slots 2221 extending in the vertical direction. Each of the plurality of guide protrusions 221 may be provided in each of the plurality of guide slots 2221 and moves up and down along each of the plurality of guide slots 2221, thereby guiding the suction nozzle 210 to be movable up and down with respect to the cleaner main body 200. The suction nozzle 210 may be supported by the supporter 220 to be movable up and down. The supporter 220 may also include a plurality of guide portions 222 having a plurality of rail portions or rails 2222, which will be described in more detail later.

Figure 12:
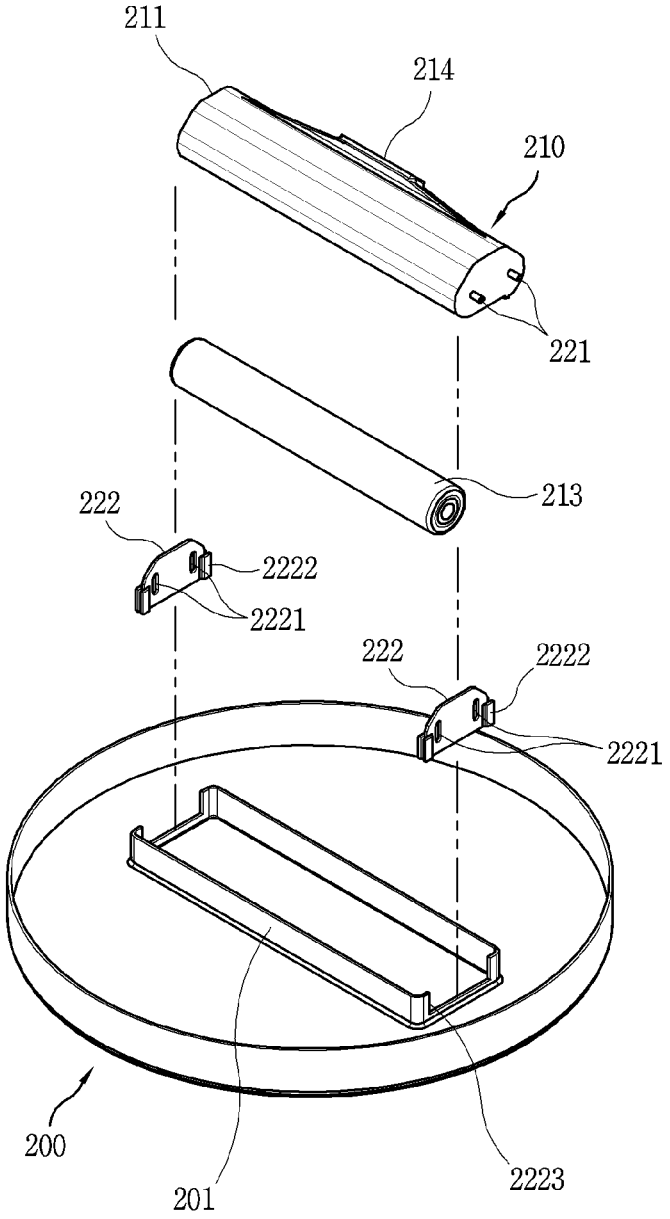
FIG. 12 is an exploded view illustrating a state in which the suction nozzle is disassembled from the cleaner main body of FIG. 10.
Figure 13:
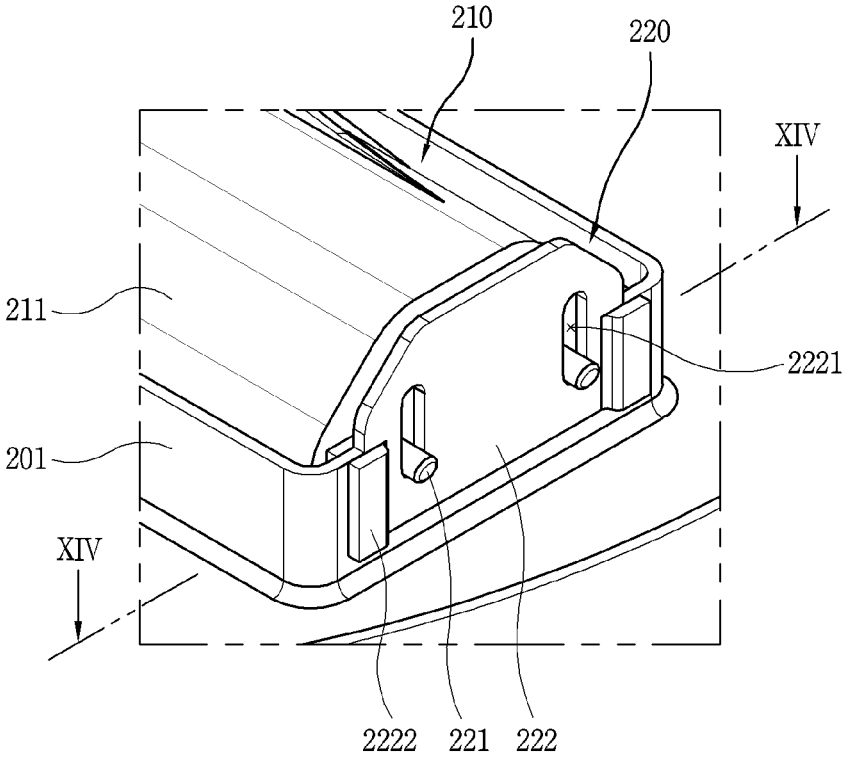
FIG. 13 is an enlarged view of a part "VIII" in FIG. 10.
Figure 14:
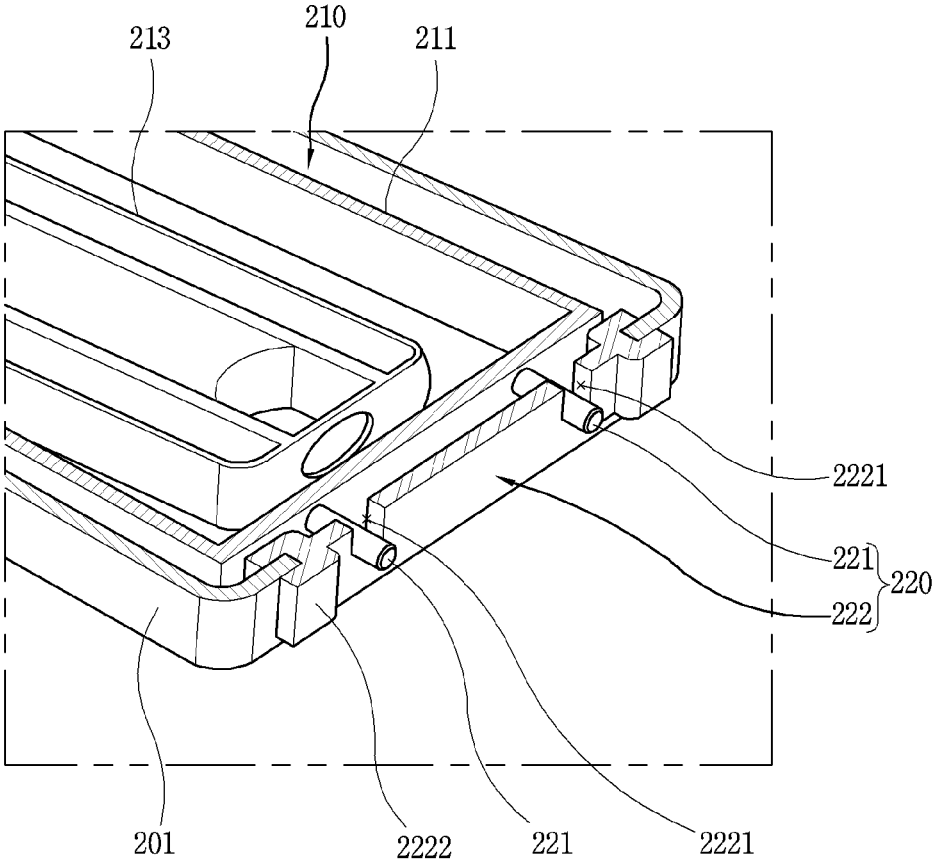
FIG. 14 is a sectional view illustrating a coupling relationship between a rail portion of a guide holder and an accommodating portion, taken along line XIV-XIV in FIG. 13.

Referring to FIGS. 12-13, the supporter 220 may be provided at both (i.e., left and right) end side surfaces of the suction nozzle 210 and at both (i.e., left and right) end side surfaces of the accommodating portion 201, respectively, or alternatively may be provided at a front surface and a rear surface of the suction nozzle 210 and the accommodating portion 201, respectively. In this embodiment, the supporter 220 may be provided at both end side surfaces of the suction nozzle 210 and the both end side sides of the accommodating portion 201, respectively.

The plurality of guide protrusions 221 may be provided at both end side surfaces of the suction nozzle 210, and the plurality of guide slots 2221 may be provided at both side surfaces of the accommodating portion 201. However, embodiments disclosed herein are not limited, and the plurality of guide protrusions may be provided at both side surfaces of the accommodating portion 201, and the plurality of guide slots may be provided at both end side surfaces of the suction nozzle 210.

The plurality of guide protrusions 221 may protrude and extend in a lateral or left-right direction from both end side surfaces of the suction nozzle 210. Each of the plurality of guide protrusions 221 may be formed in a cylindrical shape.

The plurality of guide protrusions 221 may be spaced apart in a front-rear direction of the suction nozzle 210. The plurality of guide protrusions 221 may be positioned at a height that is the same as or similar to each other.

Mounting portions or edges 2223 may be provided at both end side surfaces of the accommodating portion 201 in the lateral direction, respectively. Each of the plurality of mounting portions 2223 may be penetrated in the lateral direction of the accommodating portion 201 and opened upward.

The plurality of guide holders 222 may be respectively mounted on the plurality of mounting portions 2223. The guide holder 222 may be formed in a shape of a plate. The guide holder 222 may be provided to face the both end side surfaces of the suction nozzle 210.

Each of the plurality of guide holders 222 may include the plurality of guide slots 2221 and the plurality of rail portions 2222. Both end portions of each of the plurality of rail portions 2222 are formed to protrude from both ends of the guide holder 222 in a front-rear direction of the guide holder 222, and may extend in a front-rear direction of the mounting portion 2223 to surround and cover each of both inner end portions defining the mounting portion 2223. Both (i.e., left and right) end portions of each rail portion 2222 may be provided to overlap inner end portions of the mounting portion 2223 in a thickness direction.

Each of the plurality of rail portions 2222 may extend in a vertical direction. Slide grooves each may be formed at an inner side of the rail portion 2222. Each of the plurality of rail portions 2222 may be formed in a U-shape. When looking down at the rail portion 2222 from above, a cross-section area of the rail portion 2222 may resemble a U or otherwise have a slot or recess in which the mounting portions 2223 may be inserted.

The slide grooves each formed at an inner side of the rail portion 2222 may be opened toward inner end portions of the mounting portion 2223 at both inner end portions of the guide holder 222 in the front-rear direction.

An inner front end portion and an inner rear end portion of the mounting portion 2223 are respectively provided in the slide groove of the rail portion 2222, and each of the plurality of rail portions 2222 may be vertically slidably coupled to the inner front end portion and the inner rear end portion of the mounting portion 2223, respectively.

The guide holder 222 may be provided perpendicular to a protruding direction of the plurality of guide protrusions 221. The plurality of guide slots 2221 may be formed to penetrate in a thickness direction of the guide holder 222 so that the guide protrusions 221 may pass through the guide holder 222 through the guide slots 2221.

Each of the plurality of guide slots 2221 may extend vertically in an up-down direction of the guide holder 222. The guide slot 2221 may be formed in a rectangular shape whose vertical length in the up-down direction may be longer than its horizontal length in the front-rear direction.

A left-right width of the guide slot 2221 may be formed to correspond to a diameter of the guide protrusion 221. A vertical length of the guide slot 2221 may be formed to be longer than the diameter of the guide protrusion 221. The guide protrusion 221 may be provided in the guide slot 2221 to be moved vertically along the guide slot 2221. An upper end portion and a lower end portion of the guide slot 221 may be formed in a semicircular shape to surround an upper semicircle or a lower semicircle in an outer circumferential surface of the guide protrusion 221 to limit a movable range in an up-down direction of the guide protrusion 221.

According to this configuration, a lower end of the guide slot 2221 may limit a lowest downwardly movable height of the guide protrusion 221, and an upper end of the guide slot 2221 may limit a highest upwardly movable height of the guide protrusion 221. When the guide protrusion 221 contacts the upper end of the guide slot 2221, the guide protrusion 221 may stops=moving up, and the guide protrusion 221 may be positioned at a highest point. When the guide protrusion 221 is brought into contact with the lower end of the guide slot 2221, the guide protrusion 221 may stop moving down, and the guide protrusion 221 may be positioned at a lowest point. The guide protrusion 221 may linearly move in the up-down direction between the highest point and the lowest point along the guide slot 2221.

According to this configuration, when the agitator 213 receives an upward pressure from the floor as the height of the floor increases, the guide protrusion 221 may vertically move upward along the guide slot 2221, and the suction nozzle 210 may move up with respect to the cleaner main body 200. When the agitator 213 moves down to the floor by gravity as the height of the floor decreases, the guide protrusion 221 may vertically move downward along the guide slot 2221, and the suction nozzle 210 may move down with respect to the cleaner main body 200.

Although the driving wheels 202 sink when the cleaner main body 200 travels on a soft floor such as a carpet, the guide ribs 221 move up along the guide slits 2221 by a height of the floor when the agitator 213 of the suction nozzle 210 may be brought into contact with the floor, and the suction nozzle 210 may move up with respect to the cleaner main body 200 by the height of the floor so that travel performance can be improved by reducing a possibility of being caught by the floor.

As the suction nozzle 210 moves up with respect to the cleaner main body 200, a compression force between the agitator 213 and the floor may decrease to increase a suction pressure that suctions air through the suction port, thereby improving cleaning performance.

Referring to FIGS. 16-19, a robot cleaner described with reference to FIGS. 16-22 may be different from the robot cleaner described with reference to FIGS. 10-15 in an implementation of a supporter 320. The supporter 320 may be provided on a front surface and a rear surface of an accommodating portion 301 and on a front surface and a rear surface of a suction nozzle 310, respectively. Other components may be the same or similar to those described with reference to FIGS. 10-15, and redundant descriptions will be omitted while different components will be mainly described.

Figure 20:
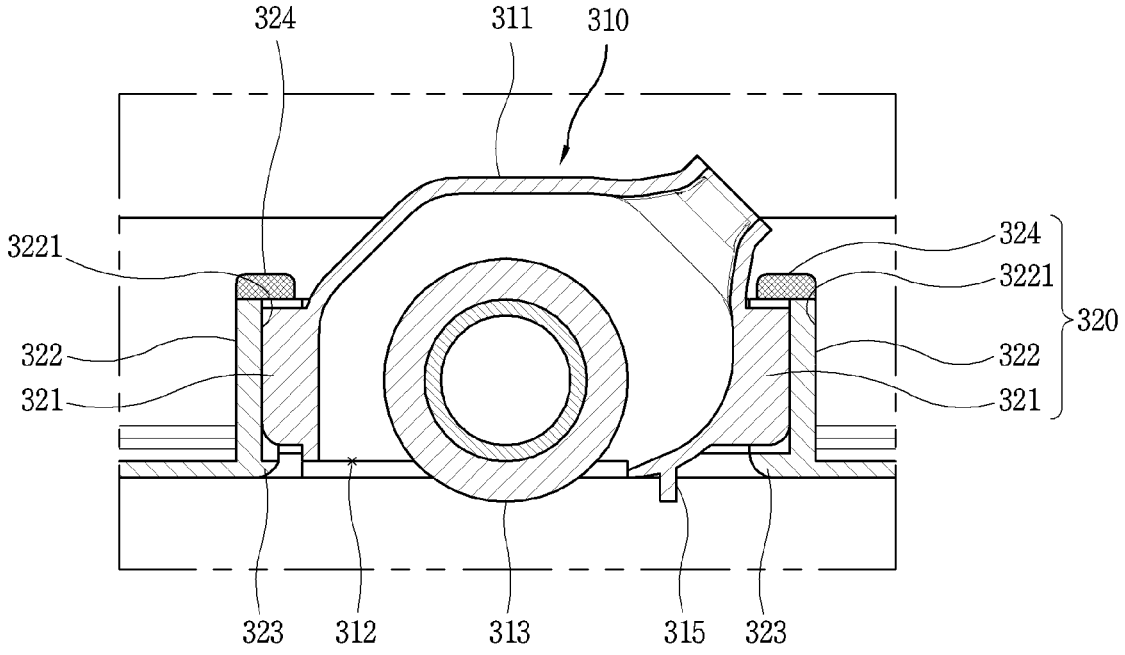
FIG. 20 is a sectional view, taken along line XX-XX in FIG. 19.
Figure 21:
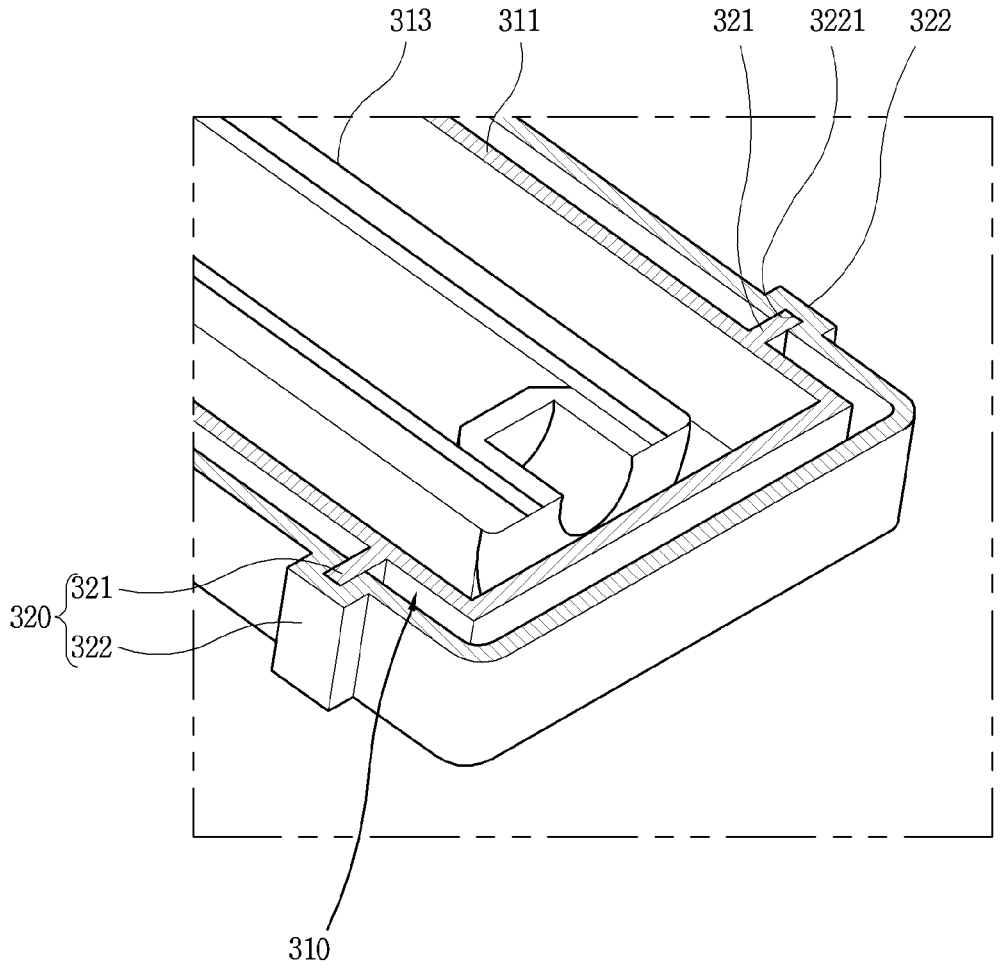
FIG. 21 is a sectional view, taken along line XXI-XXI in FIG. 19.

The supporter 320 may include a plurality of guide ribs 321 and a plurality of guide slits 3221 (FIGS. 20-21). The plurality of guide ribs 321 may be formed to protrude in a front-rear direction from a front surface and a rear surface of the suction nozzle 310, respectively.

Each of the plurality of guide ribs 321 may be formed in a rectangular plate shape and extend in a front-rear direction. Each of the plurality of guide ribs 321 may be formed in a rectangular shape whose front-rear length may be longer than its left-right width, but embodiments disclosed herein are not limited. In addition, a vertical length of each of the guide ribs 321 may be longer than the front-rear length and also longer than the left-right width.

The plurality of guide ribs 321 may be provided to be spaced apart in a lateral direction of the suction nozzle 310 on the front and rear surfaces of the suction nozzle 310.

The plurality of guide ribs 321 may be provided close to both (i.e., left and right) ends in the lateral direction of the suction nozzle 310 on the front surface or on the rear surface of the suction nozzle 310 to stably support a vertical movement of the suction nozzle 310. The plurality of guide ribs 321 may be formed to protrude in parallel from a front vertical plane and a rear vertical plane of the suction nozzle 310, respectively.

A plurality of guide holders 322 may be formed to protrude from a front surface and a rear surface of the accommodating portion 301 of the cleaner main body 300 in a direction parallel to a protruding direction of the plurality of guide ribs 321. The guide holder 322 may extend perpendicularly upward in a height direction of the accommodating portion 301. The guide holder 322 may be formed in a rectangular shape whose vertical length may be longer than its left-right length and/or front-rear length.

The plurality of guide holders 322 may be spaced apart from each other in a lateral or left-right direction of the accommodating portion 301 on the front surface and the rear surface of the accommodating portion 301, respectively. The guide holders 322 may be provided at the accommodating portion 301 to face the guide ribs 321.

Referring to FIGS. 16-22, the guide slit 3221 may be formed at an inner side of the guide holder 322. The guide slit 3221 may be formed in a rectangular shape whose vertical length may be longer than its left-right length and/or front-rear length. A width of the guide slit 3221 may correspond to a thickness of the guide rib 321. The guide slit 3221 may be formed to be concave in the guide holder 322. Accordingly, the guide rib 321 may be provided in the guide slit 3221, and the guide holder 322 may surround both side surfaces of the guide rib 321.

A vertical length of the guide slit 3221 may extend longer than a vertical length of the guide rib 321. The guide rib 321 may be provided inside the guide holder 322 to be linearly moved in the vertical direction along the guide slit 3221.

A lower stopper 323 may be provided at a lower portion of the guide holder 322. The lower stopper 323 may extend horizontally from a lower surface of the guide holder 322 to cover a lower portion of the guide slit 3221. The lower stopper 323 may be configured to limit a lowest point to which the guide rib 321 moves down along the guide slit 3221.

An upper portion of the guide slit 3221 may be opened. A plurality of upper stoppers 324 may be respectively mounted on upper portions of the plurality of guide holders 322 to cover upper portions of the guide slits 3221.

Figure 22:
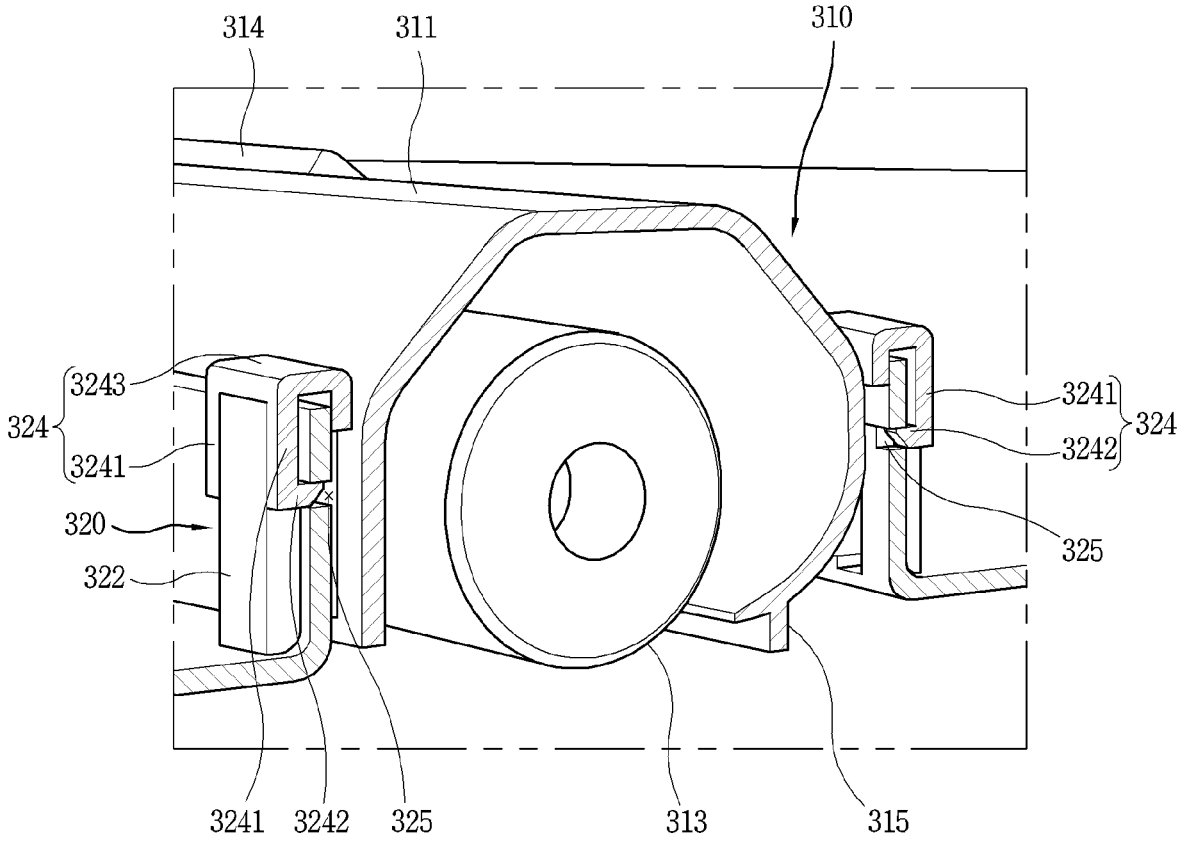
FIG. 22 is a sectional view, taken along line XXII-XXII in FIG. 19.

Each of the plurality of upper stoppers 324 may include a stopper body 3243 and a plurality of hooks 3241 (FIG. 22). The stopper body 3243 may be formed in a rectangular shape whose left-right length in the lateral direction of the accommodating portion 301 may be longer than its vertical length of the accommodating portion 301. The stopper body 3243 may extend in the lateral direction of the accommodating portion 301.

The stopper body 3243 may be provided to cover an upper end portion of the guide holder 322. The stopper body 3243 may have a left-right length extending longer than a left-right length of the guide holder 322, and both (i.e., left and right) end portions of the stopper body 3242 may protrude from both (i.e., left and right) side surfaces of the guide holder 322 in the left-right or lateral direction of the accommodating portion 301.

When the stopper body 3243 is viewed from a top of the accommodating portion 301, the stopper body 3243 may be formed in a rectangular shape whose left-right length may be longer than its front-rear length. The front-rear thickness or length of the stopper body 3243 may be longer than the front-rear thickness or length of the guide holder 322. One end portion of the stopper body 3243 in the front-rear direction may protrude inward to the accommodating portion 301. In addition, a left-right length of the stopper body 3243 may be longer than a left-right length of the guide holder 322 so as to be provided at outer sides of the guide holder 322.

A guide groove may be formed at an inner side of the stopper body 3243. The guide groove may be formed in a shape corresponding to the guide rib 321, and may be configured to receive an upper end portion of the guide rib 321 when the guide rib 321 moves up.

The plurality of hooks 3241 may extend to protrude downward from both sides of the stopper body 3241 with the guide holder 322 interposed therebetween. At a lower end of each of the plurality of hooks 3241, a locking portion or lock 3242 may be formed to protrude toward the accommodating portion 301 in a wedge shape.

A plurality of coupling holes 325 at the accommodating portion 301 may be formed to face the locking portion 3242 of the hook 3241. Since each of the locking portions 3242 of each of the hooks 3241 may be fitted into the coupling hole 325, the upper stopper 324 may be fixed or coupled to the accommodating portion by the hook 3241. The upper stopper 324 may limit a highest point of the guide rib 321 when the guide rib 321 moves upward along the guide slit 3221.

Although driving wheels 302 sink when the cleaner main body 300 travels on a soft floor such as a carpet, the guide ribs 321 may move up along the guide slits 3221 by a height of the floor when an agitator 313 of the suction nozzle 310 contacts the floor, and the suction nozzle 310 may move up with respect to the cleaner main body 300 by the height of the floor so that travel performance may be improved by reducing a possibility of catching the floor. As the suction nozzle 310 moves up with respect to the cleaner main body 300, a compression force between the agitator 313 and the floor may decrease so as to increase a suction pressure that suctions air through a suction port, improving cleaning performance.

The suction nozzle 310 may be set at an initial position with respect to a height between a floor and to nozzle body 311 based on a hard floor such as a floor plate. There may further be a suction port 312 through which foreign matter is suctioned. The suction nozzle 310 of the present disclosure may be referred to as a floating nozzle. The floating nozzle may refer to a nozzle that moves up and down according to a change in a height of a floor. The floating nozzle according to the present disclosure may be applied not only to a robot cleaner but also to a cleaner that collects foreign substances in sucked air.

The present disclosure may solve problems of the related art by providing a robot cleaner capable of easily responding to changes in a height of a floor to improve travel performance and implement an operation that can help in climbing obstacles. Embodiments disclosed herein may provide a robot cleaner capable of improving cleaning performance by maintaining a surface pressure of a suction nozzle and increasing a suction pressure even when a height difference of a floor may be large.

Embodiments disclosed herein may provide a robot cleaner, including a cleaner main body that autonomously travels, a suction nozzle mounted to be able to move up and down or swing with respect to the cleaner main body, and a supporter to support the suction nozzle to be able to move up and down or swing. The supporter may include a plurality of ball joints coupled to the cleaner main body and the suction nozzle, respectively, by the plurality of ball joints to support the suction nozzle to be able to move up and down or swing in a front-rear direction, and the plurality of ball joints may include a first joint housing coupled to the cleaner main body, a second joint housing coupled to the suction nozzle, and a plurality of ball portions provided in each of the first joint housing and the second joint housing.

The supporter may further include a connecting bar to connect the plurality of ball portions, and one end or a first end portion of the connecting bar connected to a ball portion provided in the second joint housing may be located higher than another end or a second end portion of the connecting bar connected to a ball portion provided in the first joint housing, and the suction nozzle may be supported by being suspended from the another end portion of the connecting bar. The plurality of ball joints may include a first ball joint provided at the cleaner main body and a second ball joint provided at the suction nozzle, and the first ball joint and the second ball joint may be positioned in the front-rear direction with a height difference.

The suction nozzle may be formed to be elongated in a direction crossing a traveling direction of the cleaner main body, the ball joint provided at the suction nozzle may be provided at a central portion in a lengthwise direction of the suction nozzle, the cleaner main body may have an accommodating portion or space to accommodate or receive the suction nozzle, and the ball joint provided in the cleaner main body may be provided at a central portion in a lengthwise direction of the accommodating portion.

The supporter may be installed inside the cleaner main body and provided in front of the suction nozzle. The ball joint may support the suction nozzle to be able to swing in a left-right direction with respect to a center in a lengthwise direction of the suction nozzle.

The ball joint may further include a plurality of joint covers each mounted to cover an opening of each of the first joint housing and the second joint housing, and a guide groove surrounding the ball portion may be formed inside each of the first joint housing, the second joint housing, and the plurality of joint covers, in a shape corresponding to the ball portion. Each of the plurality of joint covers may have a cutout groove, and a part of the connecting bar connecting the plurality of ball portions may protrude from the ball portion through the cutout groove to move in the front-rear direction and a left-right direction with respect to the joint cover.

The first ball joint may be provided with a first ball portion provided in the first joint housing, and the first ball portion may roll in a front-rear direction or a left-right direction with respect to the first joint housing to support the suction nozzle to be able to move up and down or to be able to partially move up and down in the left-right direction.

The second ball joint may be provided with a second ball portion provided in the second joint housing, and the second joint housing may rotate relative to the second ball portion to support the suction nozzle to be able to swing in a front-rear direction or a left-right direction.

The plurality of ball portions may include a first ball portion provided in the first joint housing and a second ball portion provided in the second joint housing. The supporter may further include a connecting bar extending from the first ball portion to the second ball portion and configured to surround a part of a front surface and an upper surface of the suction nozzle.

The supporter may support the suction nozzle to be movable up and down, and the supporter may include a plurality of guide protrusions protruding from both end side surfaces of the suction nozzle, and a plurality of guide holders each mounted on both end portions of an accommodating portion provided in the cleaner main body, and each provided with a plurality of guide slots each to accommodate the guide protrusion such that the plurality of guide protrusions may be movable up and down.

Each of the plurality of guide protrusions may be formed to protrude in a cylindrical shape, and each of the plurality of guide slots may be formed in a rectangular shape whose vertical length in an up-down direction may be longer than its horizontal length. Each of the plurality of guide slots may have the horizontal length corresponding to a diameter of the guide protrusion, and may have the vertical length extending longer than a diameter of the guide protrusion. The plurality of guide protrusions may pass through the plurality of guide slots at a height same as each other, and the plurality of guide slots may extend parallel to each other by a height same as each other on the guide holder.

The guide protrusion may have a circular cross-sectional shape, and an upper end portion of the guide slot may be formed in a semicircular shape to surround an upper semicircle of the guide protrusion, a lower end portion of the guide slot may be formed in a semicircular shape to surround a lower semicircle of the guide protrusion, and the upper end portion and the lower end portion of the guide slot may limit a movable height of the protrusion in an up-down direction. The guide protrusion may be located at a lower end portion of the guide slot, and may move up and down according to a height of a floor during traveling.

The accommodating portion may have a rectangular shape extending long in one direction crossing a traveling direction of the cleaner main body and protrude upward from a lower surface of the cleaner main body. Each of a plurality of mounting portions may be formed to be penetrated in the one direction and be formed to be opened upward at both end portions of the accommodating portion. A plurality of rail portions may protrude from both end portions of the guide holder to overlap inner end portions of the mounting portion in a thickness direction. The plurality of guide protrusions may be slidably coupled to be movable up and down the plurality of guide slots so that the suction nozzle may be entirely moved up and down or any one end portion of both end portions of the suction nozzle may be selectively partially moved up and down.

The supporter may support the suction nozzle to be movable up and down, and the supporter may include a plurality of guide ribs each protruding from a front surface and a rear surface of the suction nozzle with respect to a traveling direction of the cleaner main body, and a plurality of guide holders each provided with guide slits to accommodate the guide ribs so that the guide ribs are vertically movable and each provided at a front portion and a rear portion of an accommodating portion provided in the cleaner main body. Each of the plurality of guide ribs may be formed in a rectangular shape and protrude from the front surface and the rear surface of the suction nozzle in a front-rear direction, and each of the plurality of guide holders may be formed in a rectangular shape and protrude from the front portion and the rear portion of the accommodating portion, and the guide slits each may enclose the guide rib in an inner side of the guide holder and extend vertically longer than a vertical length of the guide rib.

The accommodating portion may have a rectangular shape extending long in one direction crossing the traveling direction of the cleaner main body, and may protrude upward from a lower surface of the cleaner main body. The plurality of guide holders may be spaced apart from each other in the one direction on the front portion and the rear portion of the accommodating portion. The guide slit may extend in a vertical direction of the guide holder, a width of the guide slit may correspond to a thickness of the guide rib, and the guide slit may be formed in a rectangular shape whose vertical length may be longer than its horizontal length.

The supporter may further include a lower stopper formed at a lower end portion of the guide holder in a structure blocking a lower surface of the guide holder so as to limit a lowest downwardly movable height of the guide rib. An upper portion of the guide holder may be formed to be opened, and the supporter may further include an upper stopper mounted at an upper end portion of the guide holder to cover the upper portion of the guide holder so as to limit a highest upwardly movable height of the guide rib. The upper stopper may include a stopper body, and a plurality of hooks protruding downward from the stopper body with the upper end portion of the guide holder therebetween, and a lower end of each of the plurality of hooks may be provided with a locking portion protruding therefrom to be engaged with each of a plurality of coupling holes formed at the accommodating portion.

Embodiments disclosed herein may provide a supporter which may be provided between a cleaner main body or body and a suction nozzle to support the suction nozzle with a ball joint provided at a portion connected to the cleaner main body or to the suction nozzle to be able to swing in the front-rear direction and the left-right direction or move up and down. The suction nozzle can actively respond to changes in the height of the floor, thereby improving travel performance.

The ball joint may include a first ball joint at the cleaner main body and a second ball joint at the suction nozzle. The first ball joint may support the suction nozzle to be able to move up and down, and the second ball joint may support the suction nozzle to be able to swing in the front-rear direction and the left-right direction.

The ball joint may include a joint housing and a ball portion. The joint housing may include a first joint housing provided at the cleaner main body and a second joint housing provided at the suction nozzle. The ball portion may include a first ball portion provided in the first joint housing and a second ball portion provided in the second joint housing. Each of the first ball portion and the second ball portion may perform joint motion by rolling along a guide groove formed in the first joint housing and second joint housing, respectively.

As the first ball portion may roll or rotate in the front-rear direction and the left-right direction with respect to the first joint housing, the suction nozzle may move up and down or partially move up and down. As the second ball portion rolls or rotates in the front-rear direction and the left-right direction with respect to the second joint housing, the suction nozzle may swing in the front-rear direction and the left-right direction by the second ball joint.

The first ball joint may be located at the lower surface of the cleaner main body, the second ball joint may be located at an upper portion the suction nozzle, and the supporter may be provided with the connecting bar extending from the first ball portion to the second ball portion to support the suction nozzle with a structure of the suction nozzle being suspended. Each of the first ball portion and the second ball portion may be formed in a shape of a sphere so that the suction nozzle can easily follow a climbing angle and a height difference according to a floor environment.

Guide slots and guide protrusions may be provided between the cleaner main body and the suction nozzle, respectively, and guide the suction nozzle to be able to move up and down as the guide slots move up and down along the guide slots. The suction nozzle can actively respond to changes in the height of the floor, thereby improving travel performance.

As the guide slots are spaced apart from each other and extend up and down by a height the same as or similar to each other at both side surfaces of the accommodating portion accommodating the suction nozzle, and the guide protrusions protrude in a lateral direction from both end portions of the suction nozzle to be provided in the guide slots so as to move up and down along the guide slots, the suction nozzle can move up and down according to the height difference of the floor by following the floor. Therefore, cleaning performance can be improved by maintaining a contact stress and increasing a suction pressure of the suction nozzle.

Although driving wheels may sink when the cleaner main body travels on a soft floor such as a carpet, the guide ribs may move up along the guide slits by a height of the floor when an agitator of the suction nozzle may be brought into contact with the floor, and the suction nozzle may move up with respect to the cleaner main body by the height of the floor so that travel performance can be improved by preventing or reducing a phenomenon of being caught by the floor.

As the suction nozzle moves up with respect to the cleaner main body, a compression force between the agitator and the floor may decrease to increase a suction pressure to suction air through the suction port, thereby improving cleaning performance.

Embodiments disclosed herein may be implemented as a cleaner comprising a main body, an opening provided in the main body, an agitator case provided in the opening, an agitator provided in the agitator case, and a support coupled to the agitator and the main body. The support may be configured to allow movement of the agitator case in a vertical direction perpendicular to the floor surface based on a contour of the floor surface.

The support may be coupled to the main body and the agitator case by at least one ball joint so as to allow a movement of the agitator and the agitator case with respect to the main body when the main body travels on the floor surface in a first direction. The ball joint may suspend the agitator case to allow pivoting of the agitator case about the ball joint. The support may include a bar made of pliable material and coupled to the ball joint to facilitate a movement of the agitator case based on a deformation of the bar.

The at least one ball joint may include a first ball joint and a second ball joint. The first ball joint may have a first housing coupled to the main body and a first rounded head, the first housing having a first groove configured to receive the first rounded head. The second ball joint may have a second housing coupled to the agitator case and a second rounded head, the second housing having a second groove configured to receive the second rounded head.

The support may include a bar to connect the first rounded head to the second rounded head. The second ball joint may be provided at a position higher than a position of the first ball joint such that the agitator may be suspended via the second ball joint.

The first ball joint may include a first cover coupled to the first housing, and the first cover may include a first cover groove configured to surround the first rounded head with the first groove. The second ball joint may include a second cover coupled to the second housing, and the second cover may include a second cover groove configured to surround the second rounded head with the second groove. Each of the first and second joint covers may have a cutout groove so as not to interfere with a movement of the bar in the first direction.

The bar may be made of a pliable material, and the first and second rounded heads and the first and second grooves have spherical shapes to allow a rolling motion of the first and second rounded heads such that a movement of the agitator case has a component in the first direction and a second direction perpendicular to the first direction.

The first ball joint and the second ball joint may be spaced apart in the first direction. The first ball joint may be provided at a height different than a height of the second ball joint.

The agitator case may have a length in a second direction perpendicular to the first direction. The second ball may be provided at a central position of the agitator case with respect to the second direction. The main body may have a wall surrounding the opening in which the agitator case may be provided, the wall having a length in the second direction. The first ball joint may be provided at a central position of the wall with respect to the second direction.

A plurality of protrusions may extend from the agitator case. The support may be configured to engage with the plurality of protrusions to guide a sliding motion of the plurality of protrusions in the vertical direction perpendicular to the floor surface.

The agitator case may have a first end and a second end. A second direction may be perpendicular to the first direction and extends between the first end and the second end. The plurality of protrusions may protrude from the first and second ends of the agitator case in the second direction. The support may include a first guide plate coupled to the main body at a first side of the opening at the first end of the agitator case and a second guide plate coupled to the main body at a second side of the opening at the second end of the agitator case. Each guide plate may be provided with a plurality of guide slots extending in the vertical direction through which the plurality of protrusions are inserted, respectively, to allow the vertical movement of the agitator case.

The protrusion may have a cylindrical shape. The guide slot may have a rectangular shape having a length in the vertical direction that may be greater than a width in the first direction.

An upper end of the guide slot may be formed in a semicircular shape to surround an upper circumferential surface of the protrusion. A lower end of the guide slot may be formed in a semicircular shape to surround a lower circumferential surface of the guide protrusion. The upper end and the lower end of the guide slot may limit a range of motion of the protrusion in the vertical direction. The width of the guide slot may correspond to a diameter of the protrusion.

The plurality of protrusions may be provided at a same height with respect to a bottom of the guide plate. The plurality of guide slots may be parallel to each other and provided at a same height with respect to the bottom of the guide plate.

A rectangular wall may surround the opening and protrude upward from a lower surface of the main body. The rectangular wall may have a length in the second direction that may be greater than a width in the first direction.

The rectangular wall may include a first wall and a second wall extending in the first direction, a first recess formed in the first wall and configured to receive the first guide plate, and a second recess formed in the second wall and configured to receive the second guide plate. A pair of rail guides may be provided at edges of the first and second plates. The rail guides may be configured to slide onto inner ends of the first and second walls that define the first and second recesses to couple the first and second guide plates to the first and second walls.

A wall may surround the opening and protrude upward from a lower surface of the main body. The agitator case may have a first side and a second side, the first direction extending between the first side and the second side. The plurality of protrusions may protrude from the first and second sides of the agitator case in the first direction. The wall may include a plurality of guide grooves in which the plurality of protrusions are inserted to slide in the vertical direction along the guide grooves.

The protrusion may be formed in a rectangular rib shape. The wall may include a plurality of guide projections protruding in the first direction away from the agitator case. An inner surface of each guide projection may be formed with the guide groove. The guide groove may have a vertical length in the vertical direction that may be greater than a vertical length of the protrusions to allow vertical movement of the protrusion along the guide groove.

The plurality of protrusions may be spaced apart from each other in the second direction. The plurality of guide projections may be spaced apart from each other in the second direction. The support may include a lower stopper provided at a bottom of the guide protrusion and an upper stopper provided at a top of the guide projection to limit a vertical range of motion of the protrusion in the guide groove.

The upper stopper may include a stopper body, at least one hook protruding downward from the stopper body to engage with the upper end of the guide protrusion, and a lock provided at a lower end of the hook to engage with at least one coupling opening formed in the wall.

Embodiments disclosed herein may be implemented as a cleaner comprising a main body, a plurality of wheels to allow the main body to travel, an opening provided in the main body, a case provided in the opening, a roller rotatably mounted in the case, a suction port defined in a space between the roller and the case through which foreign matter may be suctioned for collection, and a support coupled to the case and the main body. The support may be configured to allow movement of the agitator and agitator case in response to a contour of the floor surface.

Embodiments of the present disclosure are described in detail with reference to the accompanying drawings, and the same reference numerals are used to designate the same/like components and redundant description thereof will be omitted. In general, a suffix such as "module" and "unit" may be used to refer to elements or components. Use of such a suffix herein may be merely intended to facilitate description of the specification, and the suffix itself may be not intended to give any special meaning or function. In describing the present disclosure, if a detailed explanation for a related known function or construction may be considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure may be not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present. A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner, comprising:

a main body;

an opening provided in the main body;

an agitator case provided in the opening;

an agitator provided in the agitator case; and a support coupled to the agitator and the main body, wherein the support is configured to allow movement of the agitator case in a vertical direction perpendicular to the floor surface based on a contour of the floor surface, wherein the support is coupled to the main body and the agitator case by at least one ball joint so as to allow a movement of the agitator and the agitator case with respect to the main body when the main body travels on the floor surface in a first direction, wherein the ball joint suspends the agitator case to allow pivoting of the agitator case about the ball joint, and wherein the support includes a bar made of pliable material and coupled to the ball joint to facilitate a movement of the agitator case based on a deformation of the bar.

2. A cleaner, comprising:

a main body;

an opening provided in the main body;

an agitator case provided in the opening;

an agitator provided in the agitator case; and a support coupled to the agitator and the main body, wherein the support is configured to allow movement of the agitator case in a vertical direction perpendicular to the floor surface based on a contour of the floor surface, wherein the support is coupled to the main body and the agitator case by at least one ball joint so as to allow a movement of the agitator and the agitator case with respect to the main body when the main body travels on the floor surface in a first direction, wherein the at least one ball joint includes a first ball joint and a second ball joint, and wherein:

the first ball joint has a first housing coupled to the main body and a first rounded head, the first housing having a first groove configured to receive the first rounded head, and the second ball joint has a second housing coupled to the agitator case and a second rounded head, the second housing having a second groove configured to receive the second rounded head.

3. The cleaner of claim 2, wherein the support further includes a bar to connect the first rounded head to the second rounded head, and the second ball joint is provided at a position higher than a position of the first ball joint such that the agitator is suspended via the second ball joint.

4. The cleaner of claim 3, wherein:

the first ball joint includes a first cover coupled to the first housing, and the first cover includes a first cover groove configured to surround the first rounded head with the first groove; and the second ball joint includes a second cover coupled to the second housing, and the second cover includes a second cover groove configured to surround the second rounded head with the second groove.

5. The cleaner of claim 4, wherein each of the first and second joint covers has a cutout groove so as not to interfere with a movement of the bar in the first direction.

6. The cleaner of claim 3, wherein the bar is made of a pliable material, and the first and second rounded heads and the first and second grooves have spherical shapes to allow a rolling motion of the first and second rounded heads such that a movement of the agitator case has a component in the first direction and a second direction perpendicular to the first direction.

7. The cleaner of claim 2, wherein the first ball joint and the second ball joint are spaced apart in the first direction, and the first ball joint is provided at a height different than a height of the second ball joint.

8. The cleaner of claim 2, wherein:

the agitator case has a length in a second direction perpendicular to the first direction, the second ball is provided at a central position of the agitator case with respect to the second direction, the main body has a wall surrounding the opening in which the agitator case is provided, the wall having a length in the second direction, and the first ball joint is provided at a central position of the wall with respect to the second direction.

9. A cleaner, comprising:

a main body;

an opening provided in the main body;

an agitator case provided in the opening;

an agitator provided in the agitator case; and a support coupled to the agitator and the main body, wherein the support is configured to allow movement of the agitator case in a vertical direction perpendicular to the floor surface based on a contour of the floor surface, wherein a plurality of protrusions extend from the agitator case, and the support is configured to engage with the plurality of protrusions to guide a sliding motion of the plurality of protrusions in the vertical direction perpendicular to the floor surface.

10. The cleaner of claim 9, wherein:

the agitator case has a first end and a second end, wherein a second direction is perpendicular to the first direction and extends between the first end and the second end;

the plurality of protrusions protrude from the first and second ends of the agitator case in the second direction; and the support includes a first guide plate coupled to the main body at a first side of the opening at the first end of the agitator case and a second guide plate coupled to the main body at a second side of the opening at the second end of the agitator case, each guide plate provided with a plurality of guide slots extending in the vertical direction through which the plurality of protrusions are inserted, respectively, to allow the vertical movement of the agitator case.

11. The cleaner of claim 10, wherein the protrusion has a cylindrical shape, and the guide slot has a rectangular shape having a length in the vertical direction that is greater than a width in the first direction.

12. The cleaner of claim 11, wherein an upper end of the guide slot is formed in a semicircular shape to surround an upper circumferential surface of the protrusion, a lower end of the guide slot is formed in a semicircular shape to surround a lower circumferential surface of the guide protrusion, and the upper end and the lower end of the guide slot limit a range of motion of the protrusion in the vertical direction.

13. The cleaner of claim 10, wherein the width of the guide slot corresponds to a diameter of the protrusion.

14. The cleaner of claim 10, wherein the plurality of protrusions are provided at a same height with respect to a bottom of the guide plate, and the plurality of guide slots are parallel to each other and provided at a same height with respect to the bottom of the guide plate.

15. The cleaner of claim 10, further comprising a rectangular wall surrounding the opening and protruding upward from a lower surface of the main body, the rectangular wall having a length in the second direction that is greater than a width in the first direction;

the rectangular wall includes a first wall and a second wall extending in the first direction, a first recess formed in the first wall and configured to receive the first guide plate, and a second recess formed in the second wall and configured to receive the second guide plate; and a pair of rail guides are provided at edges of the first and second plates, the rail guides being configured to slide onto inner ends of the first and second walls that define the first and second recesses to couple the first and second guide plates to the first and second walls.

16. The cleaner of claim 9, further comprising a wall surrounding the opening and protruding upward from a lower surface of the main body, wherein:

the agitator case has a first side and a second side, the first direction extending between the first side and the second side;

the plurality of protrusions protrude from the first and second sides of the agitator case in the first direction; and the wall includes a plurality of guide grooves in which the plurality of protrusions are inserted to slide in the vertical direction along the guide grooves.

17. The cleaner of claim 16, wherein:

the protrusion is formed in a rectangular rib shape;

the wall includes a plurality of guide projections protruding in the first direction away from the agitator case;

an inner surface of each guide projection is formed with the guide groove; and the guide groove has a vertical length in the vertical direction that is greater than a vertical length of the protrusions to allow vertical movement of the protrusion along the guide groove.

18. The cleaner of claim 17, wherein the plurality of protrusions are spaced apart from each other in the second direction, and the plurality of guide projections are spaced apart from each other in the second direction.

19. The cleaner of claim 17, wherein the support further includes a lower stopper provided at a bottom of the guide protrusion and an upper stopper provided at a top of the guide projection to limit a vertical range of motion of the protrusion in the guide groove.

20. The cleaner of claim 19, wherein the upper stopper includes:

a stopper body;

at least one hook protruding downward from the stopper body to engage with the upper end of the guide protrusion; and a lock provided at a lower end of the hook to engage with at least one coupling opening formed in the wall.

21. A cleaner, comprising:

a main body;

a plurality of wheels to allow the main body to travel;

an opening provided in the main body;

a case provided in the opening;

a roller rotatably mounted in the case;

a suction port defined in a space between the roller and the case through which foreign matter is suctioned for collection; and a support coupled to the case and the main body, wherein the support is configured to allow movement of the roller and case in response to a contour of a floor surface, wherein the support is coupled to the main body and the case by at least one ball joint so as to allow a movement of the roller and the case with respect to the main body when the main body travels on the floor surface in a first direction, wherein the ball joint suspends the case to allow pivoting of the case about the ball joint, and wherein the support includes a bar made of pliable material and coupled to the ball joint to facilitate a movement of the case based on a deformation of the bar.

* * * * *